US007699431B2

(12) United States Patent
Nakazawa et al.

(10) Patent No.: US 7,699,431 B2
(45) Date of Patent: Apr. 20, 2010

(54) INK JET PRINTING APPARATUS, METHOD OF MANUFACTURING INK ABSORBER, AND INK ABSORBER

(75) Inventors: Koichiro Nakazawa, Tokyo (JP); Nobuhito Yamaguchi, Tokyo (JP); Takuei Ishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 257 days.

(21) Appl. No.: 10/581,092

(22) PCT Filed: Nov. 18, 2005

(86) PCT No.: PCT/JP2005/021634

§ 371 (c)(1),
(2), (4) Date: May 31, 2006

(87) PCT Pub. No.: WO2006/054796

PCT Pub. Date: May 26, 2006

(65) Prior Publication Data

US 2007/0109346 A1 May 17, 2007

(30) Foreign Application Priority Data

Nov. 19, 2004 (JP) ..... 2004-336365

(51) Int. Cl.
*B41J 2/165* (2006.01)

(52) U.S. Cl. ..... 347/31; 347/95

(58) Field of Classification Search ..... 347/20, 347/23, 31, 28, 100, 95, 96, 101; 106/31.27, 106/31.6, 31.13; 523/160
See application file for complete search history.

(56) References Cited

U.S. PATENT DOCUMENTS 5,428,383 A 6/1995 Shields et al.

(Continued)

FOREIGN PATENT DOCUMENTS

EP 0 841 175 5/1998

(Continued)

*Primary Examiner*—Manish S Shah
(74) *Attorney, Agent, or Firm*—Fitzpatrick, Cella, Harper & Scinto

(57) ABSTRACT

An ink jet printing apparatus is provided in which ink absorbers, capable of performing their function to the fullest extent to quickly absorb an ink that tends to coagulate, are installed to prevent an interior of the printing apparatus and the back of a print medium from being contaminated. To this end, the printing apparatus has an ink absorber that contains a coagulation inhibitor capable of inhibiting the coagulation of colorant contained in the ink. This arrangement inhibits the coagulation of the colorant on the surface or in the interior of the absorber, allowing the colorant to be absorbed quickly and uniformly into the interior of the absorber. Therefore, problems caused by a deposition of the colorant on the surface of the absorber or by a degraded absorbing capability can be alleviated, thus keeping the image output in good condition.

11 Claims, 20 Drawing Sheets

U.S. PATENT DOCUMENTS

| | | | | |
|---|---|---|---|---|
| 5,488,402 | A | 1/1996 | Shields et al. | |
| 5,518,534 | A | 5/1996 | Pearlstine et al. | |
| 5,976,230 | A | 11/1999 | Askeland et al. | |
| 6,126,268 | A | 10/2000 | Askeland et al. | |
| 6,178,009 | B1 | 1/2001 | Yamada et al. | |
| 6,309,062 | B1 | 10/2001 | Hickman et al. | |
| 6,964,466 | B1 | 11/2005 | Kodama et al. | |
| 2003/0030692 | A1* | 2/2003 | Uchida | 347/35 |
| 2003/0151639 | A1 | 8/2003 | Takahashi | |
| 2005/0041081 | A1* | 2/2005 | Horii et al. | 347/95 |
| 2006/0109322 | A1* | 5/2006 | Nakazawa et al. | 347/95 |

FOREIGN PATENT DOCUMENTS

| | | |
|---|---|---|
| EP | 1 433 612 | 6/2004 |
| JP | 56-89595 | 7/1981 |
| JP | 63-299971 | 12/1988 |
| JP | 64-9279 | 1/1989 |
| JP | 64-63185 | 3/1989 |
| JP | 5-202328 | 8/1993 |
| JP | 6-106841 | 4/1994 |
| JP | 9-118850 | 5/1997 |
| JP | 10-128964 | 5/1998 |
| JP | 11-227229 | 8/1999 |
| JP | 11-334101 | 12/1999 |
| JP | 11-343441 | 12/1999 |
| JP | 2000-351205 | 12/2000 |

* cited by examiner

1 μS AFTER

2 μS AFTER

INK JET PRINTING APPARATUS, METHOD OF MANUFACTURING INK ABSORBER, AND INK ABSORBER

TECHNICAL FIELD

The present invention relates to an ink jet printing apparatus which forms an image by applying to a print medium an ink containing a colorant that coagulates under a predetermined condition. More specifically, the present invention relates to a construction that prevents problems caused by a coagulation of the colorant in a variety of ink absorbers installed in the printing apparatus.

BACKGROUND ART

As office equipment such as computers, word processors and copying machines advance, a growing number of printing apparatus for outputting information from these equipment has become available on the market. The printing apparatus employing an ink jet printing system in particular has an advantage of being able to reduce the size of a print head easily, print an image at high resolution and high speed and print on plain paper without requiring special processing on the paper. Other advantages include low running cost, low noise and a relative ease with which a full color printing can be realized using multiple color inks. It has therefore found a wide range of applications, including personal users.

Such a widespread use can lead to the user making new demands on the ink jet printing apparatus. In recent years in particular, there are growing calls for increased image fastness such as waterfastness and lightfastness while maintaining a high color saturation. One method of enhancing the image fastness is to make some improvements on the print medium as dedicated paper. However, to stably maintain a high image fastness of various kinds of print mediums including plain paper, it is more effective to provide an ink itself with some features to achieve the above objective. For this reason, recent years have seen many novel inks developed and their applications proposed.

For example, Japanese Patent Application Laid-open No. 11-227229 discloses, in addition to the conventionally used dye inks, the development of inks containing pigments as coloring materials and a variety of printing methods using such inks. The inks containing pigments tend to stay on the surface of a print medium with the colorants in a coagulated state, when compared with inks containing dyes as colorants. Thus, the pigment colorants have features of a high color saturation which is not easily faded by sunlight and ozone. To take advantage of both the superiority of the pigment ink and the superiority of the dye ink, the above-cited reference discloses a method that selectively uses these different kinds of inks according to the kind of print medium used and the kind of image to be output. For example, the above document describes that a pigment-based black ink with low penetrability and dye-based color inks with high penetrability are prepared and that a black image may be printed with the black ink or with a combination of different color inks, depending on the kind of print medium and the kind of image to be printed. The cited reference also describes printing color inks first, followed by a black ink overlapping the first printed color inks.

Other methods for enhancing the color saturation and the image fastness propose using a reaction liquid that reacts with color inks containing colorants to make the colorants insoluble or coagulate. For example, Japanese Patent Application Laid-open No. 56-89595 discloses a method which applies a polymer solution, such as carboxymethyl cellulose, polyvinyl alcohol and polyvinyl acetate, to the print medium before printing and then prints coloring inks. Japanese Patent Application Laid-open No. 63-299971 discloses a method that involves applying to a print medium a liquid containing an organic compound having two or more cationic groups in one molecule and then printing coloring inks containing anionic dye. Japanese Patent Application Laid-open No. 64-9279 discloses a method that first applies an acidic liquid containing succinic acid to a print medium and then prints coloring inks. Japanese Patent Application Laid-open No. 64-63185 describes a method that applies to a print medium a liquid that makes a dye insoluble, before printing coloring inks containing the dye. Japanese Patent Application Laid-open No. 5-202328 describes a method which applies a reaction liquid containing polyvalent metal ion before printing coloring inks.

Further, Japanese Patent Application Laid-open Nos. 6-106841, 9-118850, 11-334101 and 11-343441, and U.S. Pat. Nos. 5,428,383, 5,488,402 and 5,976,230 disclose a set of a black ink and color inks in which at least one of the color inks exhibits a mutual reactivity with the black ink, with other inks showing no reactivity with the black ink.

All these methods listed above that use a reaction liquid are characterized in that the reaction liquid chemically reacts with the coloring inks containing colorants to coagulate the coloring inks. That is, many ink jet printing apparatus of recent years, whether they use pigments or dyes or whether they require a reaction liquid to induce coagulation, have the colorants coagulate, remain and settle on the surface of a print medium, thereby realizing a satisfactory color saturation and image fastness.

There are also growing calls for a high image quality and an ease of handling that match those of silver salt pictures. In recent years, an increasing number of printing apparatus are appearing on the market which can perform the so-called "marginless printing" by which an image is printed to the edges of the print medium.

In the conventional ink jet printing apparatus, forming an image to the edges of the print medium poses many problems to the apparatus. One of the problems is that ink that has overrun the edges of the print medium may contaminate the interior of the printing apparatus, further contaminating sheets of print medium as they are fed into the printing apparatus. Since the ink is absorbed also at the edges of the print medium, the accuracy with which the print medium is transported degrades, which is likely to result in the print medium being jammed in the apparatus.

However, a construction and method to solve the above problems accompanying the "marginless printing" have already been proposed, for example, in Japanese Patent Application Laid-open Nos. 10-128964 and 2000-351205. As a construction to realize the "marginless printing" on side edges of a print medium, Japanese Patent Application Laid-open No. 10-128964 discloses an "ink jet printing apparatus which comprises: a guide means set movable, according to the size of the print medium, in a direction perpendicular to the direction of transport of the print medium and installed inside of the side edges of the print medium; and an ink receiving means installed outside of and adjacent to the guide means in a direction perpendicular to the print medium transport direction to receive ink from the print head." That is, when the "marginless printing" is performed on print mediums of various widths, ink ejected outside of the side edges of the print medium can be received by the ink receiving means, thereby minimizing the contamination of the interior of the printing apparatus.

Japanese Patent Application Laid-open No. 2000-351205 discloses a construction to realize the "marginless printing" with respect to front and rear ends of a print medium. In this construction, a platen surface that restricts the position of the print medium during printing is formed with a hole and ink ejected outside the front or rear ends of the print medium during the printing operation is led into the hole, in which an absorbent is installed to absorb wasted ink. The mechanism to collect ink ejected outside the edges of the print medium without contaminating the interior of the apparatus is one of the important factors in realizing the "marginless printing."

In the ink jet printing apparatus, however, it is found that the use of the above inks, though it can improve the image quality on a print medium, may pose a new problem in terms of the handling of ink in the printing apparatus. One such example will be explained as follows.

Since inks are handled in the ink jet printing apparatus, a material for absorbing ink is installed inside the apparatus in a variety of forms. A waste ink absorber for example is used to absorb ink discharged from a print head in a recovery operation of the print head. Other examples include a preliminary ejection pad that accepts ink droplets ejected from the print head for stabilizing its ejection performance and an ink absorber that accepts ink droplets ejected outside the edges of the print medium during the "marginless printing." The absorbers installed at various locations in the apparatus are supposed to be able to absorb ink quickly and the material for the ink absorber is chosen based on this requirement. The quick and reliable absorption can prevent ink droplets from being scattered inside the apparatus.

However, if an ink with a coagulating property such as described above is used, a quick absorption of ink as with common dye inks becomes difficult to achieve. Such an ink has colorants not dissolved in water and ionized as with dyes but dispersed in a liquid, so when it adheres to the absorbent, it is not absorbed as quickly as water. The phenomenon and problems that the inventors of this invention have found in the process of executing the "marginless printing" using pigment inks as an example of coagulating inks and also dye inks will be explained as follows.

FIG. 13 shows a dye ink as it is ejected onto an ink absorber. In the figure, denoted 1 is a print head. Ink ejected from the print head 1 is a conventionally known water-based dye ink for use in ink jet printing. The dye used may include water-soluble dyes such as a direct dye, an acid dye and a basic dye. Denoted 2 is an ink absorber which may use any type of commonly known porous material. The ink absorber may be formed, for example, by using fibers of cellulose, rayon, acrylic, polyurethane or polyester singly or in combination and forming these fibers into fibrils or by subjecting the fibers to a hydrophilic surface treatment and laminating them in layers. The ink absorber may also be formed of porous polyethylene and melamine foam. If such an ink absorber 2 is used in combination with the dye ink, the ink will quickly be absorbed in the ink absorber, with the ink soaking into the interior of the ink absorber 2 as shown shaded in the figure.

FIG. 14 shows a pigment ink as it is ejected onto an ink absorber similar to the above. Any conventionally known pigment ink for use in ink jet printing may be used. In a combination of such a pigment ink and the ink absorber, a part of ink components such as liquid medium penetrates into the ink absorber 2. However, the pigment particles remain on the ink absorber 2 forming a deposit as an ink component left unabsorbed. That is, as shown shaded in the figure, the ink separates into a portion that penetrates into the absorber and a portion that deposits on the ink absorber and settles there.

While in the above explanation a pigment ink has been taken for example, such an ink behavior in the absorber can similarly be observed in any ink with a coagulating colorant. For example, the same also applies even to an ink composed of a mixture of dye and pigment in which the pigment constitutes a main colorant with another colorant such as a highly soluble dye mixed with it for color adjustment. The similar effect can also be produced even when a dye is used as a colorant, by using a reaction liquid that reacts with the dye to accelerate the coagulation of the colorant.

In the absorber and the preliminary ejection pad during the execution of the "marginless printing", the ink deposit on the surface of the absorber progressively increases as the number of printed sheets and the power-on time increase. Once the surface of the absorber is covered with the deposit, ink droplets landing on the absorber thereafter fail to be received in the absorber. As a result, ink bounced off the absorber surface will contaminate the interior of the printing apparatus. Further, when a large number of sheets are "marginless-printed", it is found that the ink deposit reaches the print medium transport path, contaminating the back of the print medium. Furthermore, it is also found that the ink deposit may protrude even into the print medium transport path, touching the end of the print medium, which in turn may result in a transport failure.

In the case of a waste ink absorber, the transported ink coagulates on the surface or in the interior of the absorber, inhibiting a smooth transport of ink.

FIG. 15A and FIG. 15B are schematic diagrams showing how the above problem occurs. What is shown here is an example case that uses inks and a reaction liquid that reacts with these inks to coagulate colorants. In the figures the waste ink of K, C, M, Y is transported through a tube 1521 to the waste ink absorber 1531 where it is absorbed. The reaction liquid, on the other hand, is absorbed through a tube 1522 into the same waste ink absorber 1531. The two kinds of waste liquids are mixed inside the waste ink absorber 1531 inducing a chemical reaction. Therefore, where the two waste liquids meet, an area 1553 is formed in which ink becomes stagnant because of coagulates and insoluble substances produced by the reaction. This stagnant area 1553 is small at an early stage of use of the apparatus as shown in FIG. 15A but as the number of printing operations and suction-based recovery operations increases, the region progressively expands as shown in FIG. 15B, eventually blocking an ink flow path into the waste ink absorber 1531, which in turn will adversely affect the ink suction performance during the recovery operation. If an absorber of a large capacity is prepared, the liquids are not soaked uniformly into the interior of the absorber, degrading an absorption performance and therefore an ink accommodating capacity of the absorber.

Such a problem with the waste ink absorber surfaces more or less when a pigment ink is used even if a reaction liquid is not used, because in terms of coagulating the colorant the use of the pigment ink produces the similar effect to that of the case where the reaction liquid is used.

As described above, in an ink jet printing apparatus using a coagulating ink for an improved image quality, ink absorbers installed at various locations in the apparatus have been found to have a degraded absorbing capability and unable to perform their intended function.

DISCLOSURE OF THE INVENTION

The present invention has been accomplished to solve the above problems and its objective is to provide an ink jet printing apparatus which enables absorbers to absorb liquids to their full capacity and perform their intended function without contaminating the interior of the apparatus or the back of the print medium.

A first aspect of the present invention is an ink jet printing apparatus for printing by ejecting an ink containing a colorant from a print head, comprising: at least one ink absorber containing a coagulation inhibitor and absorbing the ink discharged from the print head, the coagulation inhibitor inhibiting a coagulation of the colorant contained in the ink.

A second aspect of the present invention is an ink jet printing apparatus for printing by ejecting an ink containing a colorant from a print head, comprising: an ink absorber for absorbing the ink discharged from the print head; and an application means for applying a coagulation inhibitor to the ink absorber, the coagulation inhibitor inhibiting a coagulation of the colorant contained in the ink.

A third aspect of the present invention is a method of manufacturing an ink absorber applicable to the said jet printing apparatus, comprising the steps of: immersing the ink absorber in a liquid containing the coagulation inhibitor; and drying the ink absorber immersed with the liquid.

A forth aspect of the present invention is an ink absorber manufactured by said method.

The above and other objects, effects, features and advantages of the present invention will become more apparent from the following description of embodiments thereof taken in conjunction with the accompanying drawings.

The above and other objects, effects, features and advantages of the present invention will become more apparent from the following description of embodiments thereof taken in conjunction with the accompanying drawings.

BEST MODE FOR CARRYING OUT THE INVENTION

Now, embodiments of this invention will be described in detail.

Figure 1:
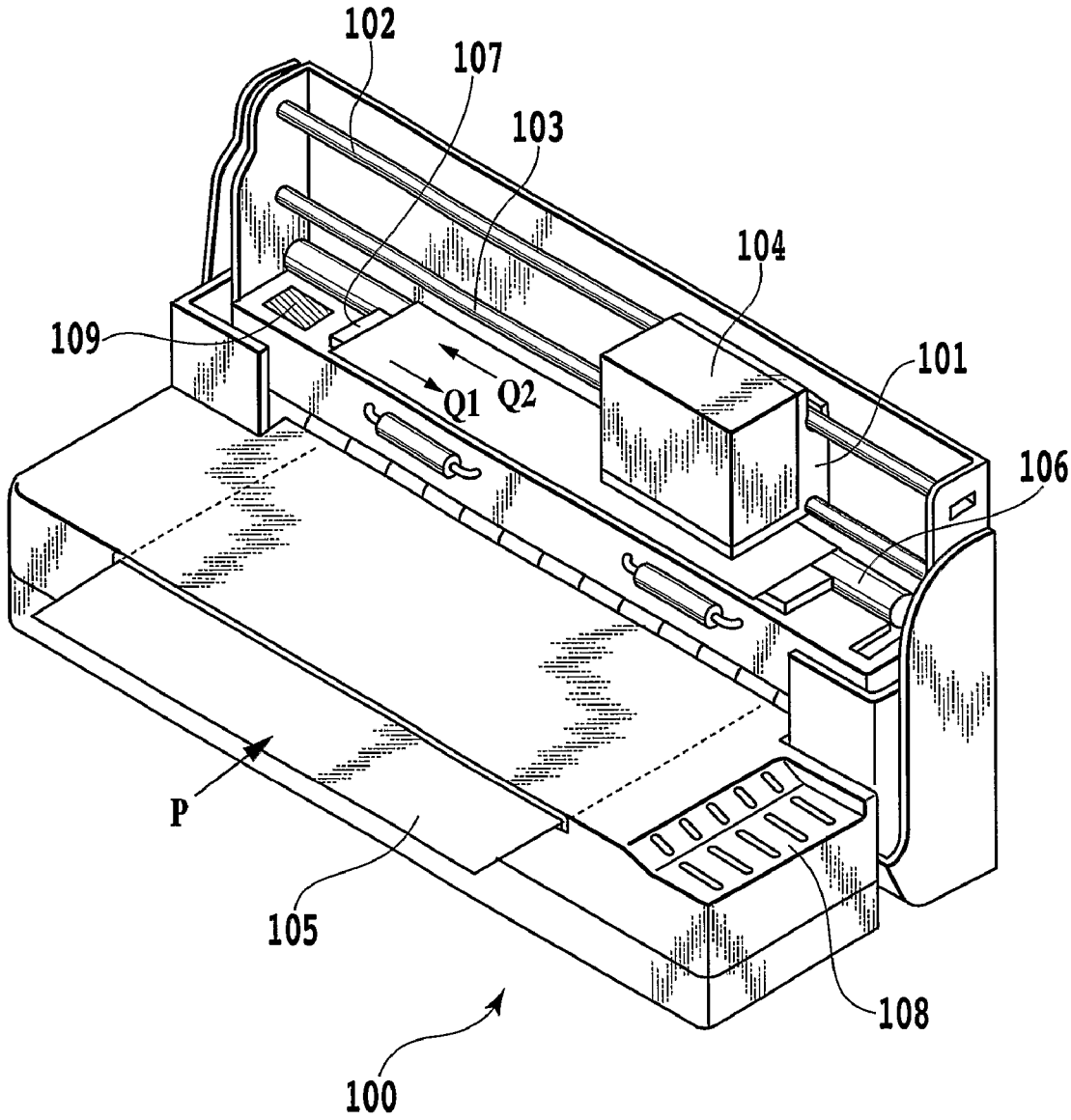
FIG. 1 is a perspective view of a serial type ink jet printing apparatus applicable to this invention.

FIG. 1 is a perspective view of a serial type ink jet printing apparatus applicable to this invention. A print medium 105 inserted at a paper feed position in the ink jet printing apparatus 100 is fed by a transport roller 106 in a direction of arrow P to a printable area of a print head 104. Under the print medium 105 in the printable area is provided a platen 107 which supports the print medium 105 from below in an area where the print head 104 executes the printing operation. It is noted, however, that a hole is formed at a position directly below the printing unit. In the hole is installed an ink absorber which absorbs ink ejected outside the edges of the print medium during the "marginless printing". Details of the printing unit will be described later.

A carriage 101 is movable along two guide shafts 102, 103 and reciprocally scans over the printing area in a main scan direction Q1, Q2. The print head 104 mounted on the carriage 101 has nozzles capable of ejecting a plurality of color inks and also includes ink tanks to accommodate a plurality of inks. These nozzle groups have their nozzle openings face down in the figure. The print medium is progressively formed with an image by repetitively alternating a main scan in which the printing operation is performed as the carriage 101 travels in Q1 or Q2 direction and a sub scan in which the print medium 105 is fed a predetermined distance.

At one end of a carriage scan area there is provided a maintenance means 109 for the print head. The maintenance means 109 has a suction-based recovery means, capping means, preliminary ejection receiver opening and wiping means for the print head. In executing the maintenance operation, the carriage 101 moves the print head 104 to directly above the maintenance means 109. Then, the individual means perform their processing on the print head 104 positioned above the maintenance means 109.

A pump, tube and waste ink absorber used for the suction operation are installed in a bottom part of the printing apparatus. In the preliminary ejection receiver opening is installed a preliminary ejection pad to absorb ink ejected during the preliminary ejection. A detailed construction of the suction-based recovery means will be described later.

Denoted 108 are a switch unit and a display unit. The switch unit is used to turn on or off the power of the printing apparatus and to set a variety of print mode. The display unit indicates a status of the printing apparatus.

Figure 2:
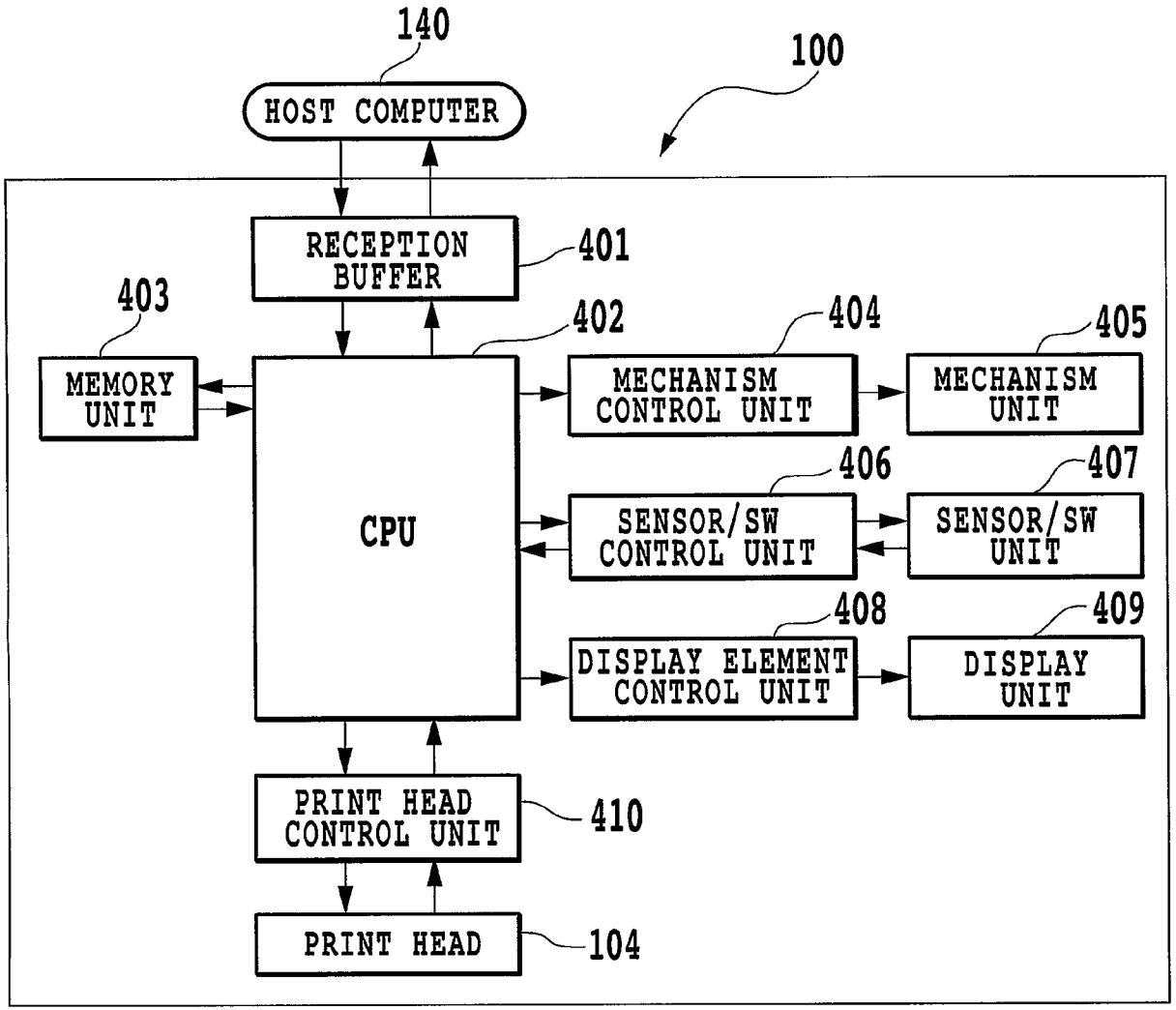
FIG. 2 is a block diagram showing a configuration of a control system for the ink jet printing apparatus applicable to this invention.

FIG. 2 is a block diagram showing a configuration of a control system in the ink jet printing apparatus 100 of FIG. 1.

In the figure, denoted 401 is a receiving buffer. The receiving buffer 401 receives character and image data to be printed from an externally connected host computer and transfers them to a CPU 402. Information as to whether data has been received correctly and information indicating the operation state of the printing apparatus 100 are also passed through the receiving buffer 401 to the host computer 140.

The image data received by the receiving buffer 401 is transferred under the control of CPU 402 to the memory unit 403 where it is temporarily stored.

A mechanism control unit 404 controls a mechanism unit 405 such as carriage motor and transport motor according to an instruction from the CPU 402. A sensor/SW control unit 406 transfers a signal from a sensor/SW unit 407 made up of various sensors and switches to the CPU 402. A display element control unit 408 controls a display unit 409 made up of LEDs and liquid crystal display elements on display panel group according to an instruction from the CPU 402. A print head control unit 410 control the print head 104 according to an instruction from the CPU 402. The print head control unit 410 also detects temperature information and others representing the state of the print head 104 and transfers them to the CPU 402.

Figure 3:
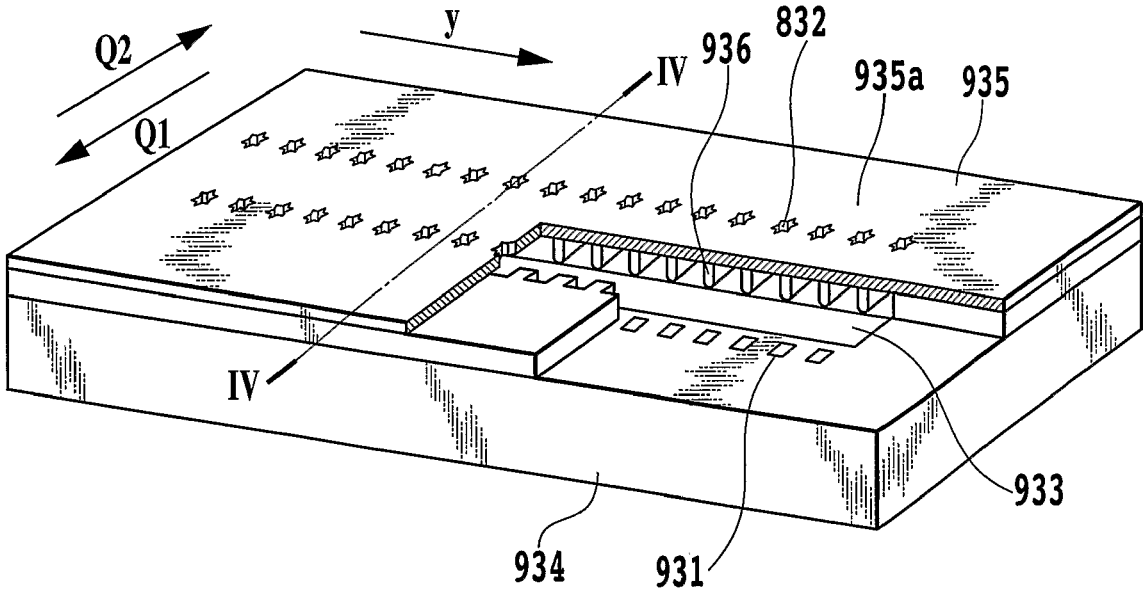
FIG. 3 is a schematic perspective view showing an essential portion of an ink jet print head applicable to the embodiment of this invention.

FIG. 3 is a perspective view schematically showing an essential part of an ink jet print head applicable to this embodiment. In the figure, denoted 934 is a substrate which, in this embodiment, is formed of glass, ceramic, plastic or metal. The material of the substrate is not an essential point of this invention and is not limited to any particular material as long as the substrate can function as part of a flow path forming member and as a support member for ink ejection energy generation elements and for a material layer forming liquid paths and ink ejection nozzles described later. In this embodiment, a silicon substrate (wafer) is used.

The substrate 934 is formed with ink ejection nozzles as by laser beam or by an exposure device such as MPA (mirror projection aligner) using an orifice plate (nozzle plate) described later made of a photosensitive resin.

The substrate 934 is also formed with a plurality of electrothermal transducers (also referred to as heaters) 931 and with an ink supply port 933 in the form of an elongate groove that also functions as a common liquid chamber. The heaters 931, the thermal energy generation means, are arranged longitudinally on both aides of the ink supply port 933 at intervals corresponding to 600 dpi (dots/inch) for example. The two columns of heaters are staggered a half pitch from each other in a y direction and therefore they together can print at a density of 1200 dpi in the y direction.

On the substrate 934 are provided ink path walls 936 to introduce ink to where heaters are located. Further on the ink path walls 936 is placed an orifice plate 935 which has nozzles 832 for ejecting ink droplets by an energy applied to individual heaters. The orifice plate 935 is water-repellent finished on the nozzle surface side (935*a*). Each of the heaters 931 is applied a pulse voltage at a drive frequency of 10 kHz to be able to eject ink every about 100 μsec.

FIGS. 4-11 are head cross sections showing how an actual ink ejection operation is performed with elapse of time. Here, the cross sections of the print head are taken along the IV-IV line of FIG. 3.

Figure 4:
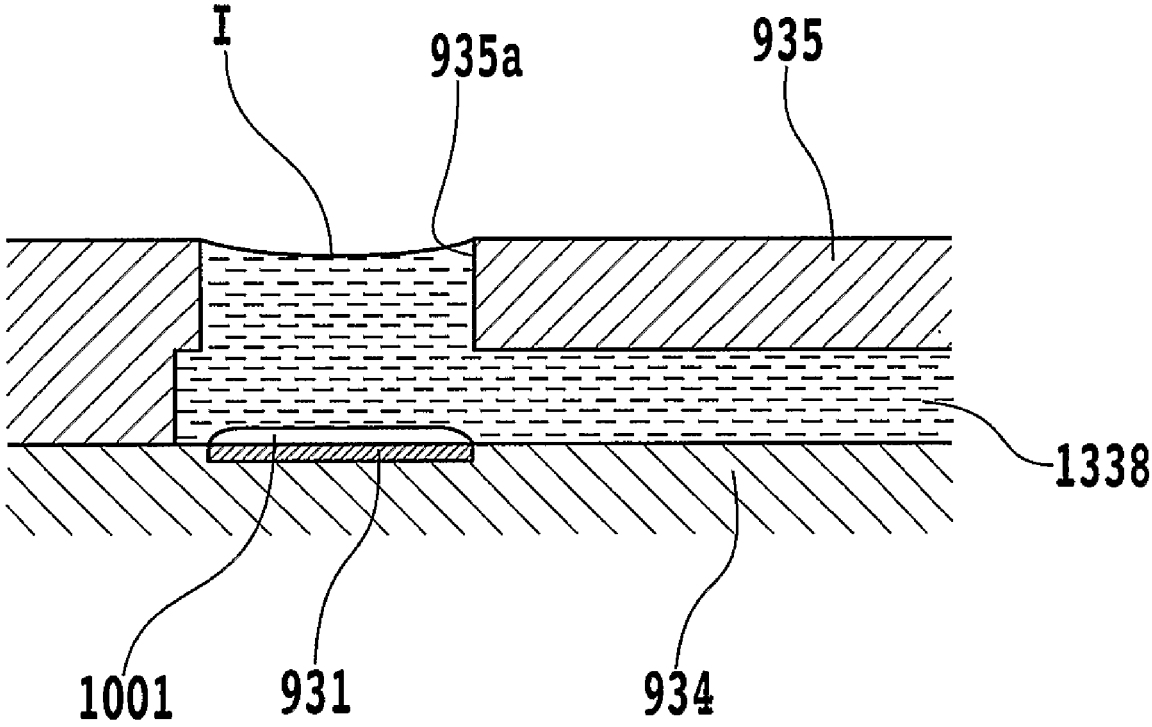
FIG. 4 is a cross-sectional view of the head showing an ejection operation with an elapse of time.
Figure 5:
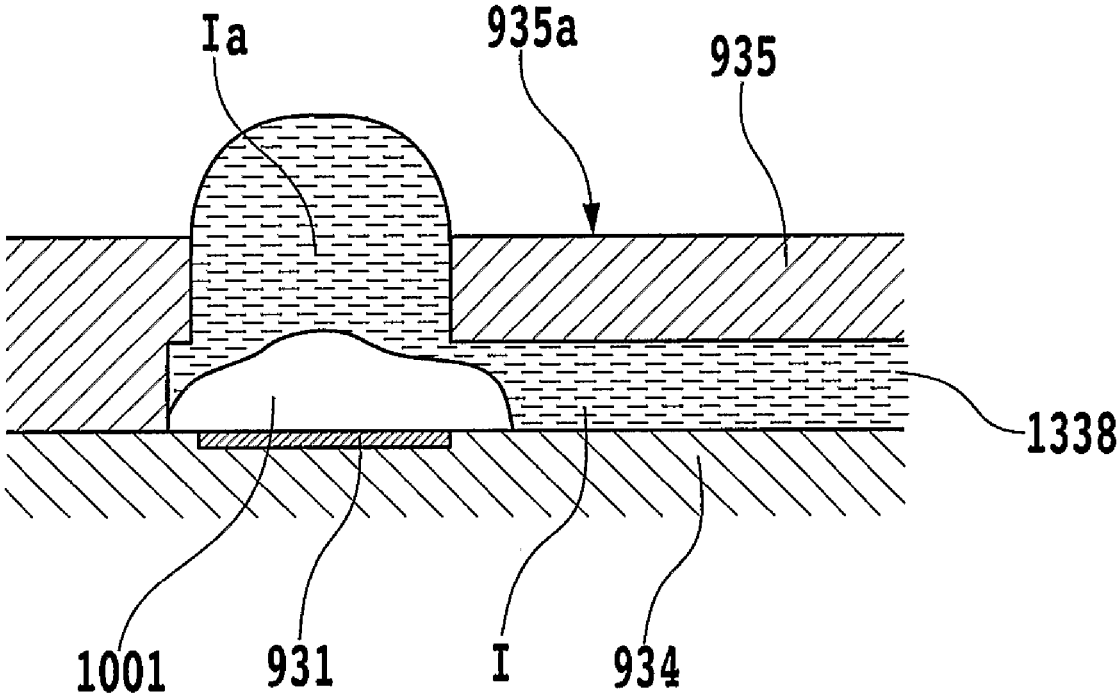
FIG. 5 is a cross-sectional view of the head showing an ejection operation with an elapse of time.
Figure 6:
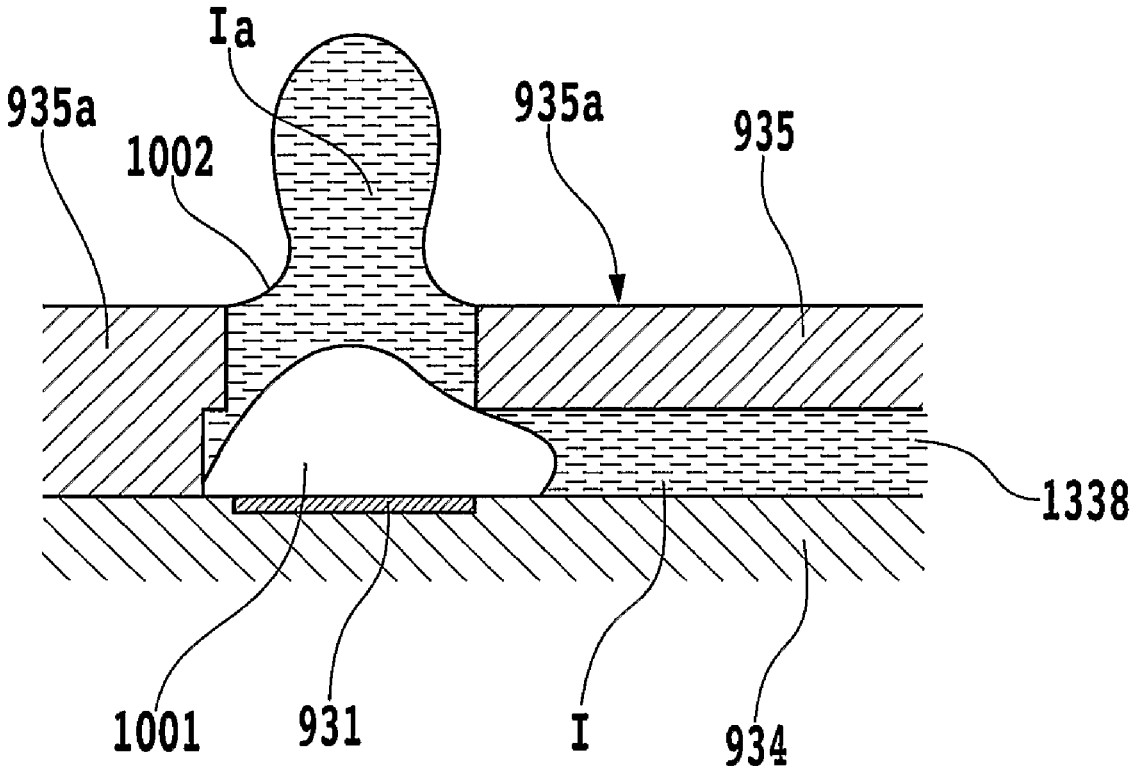
FIG. 6 is a cross-sectional view of the head showing an ejection operation with an elapse of time.
Figure 7:
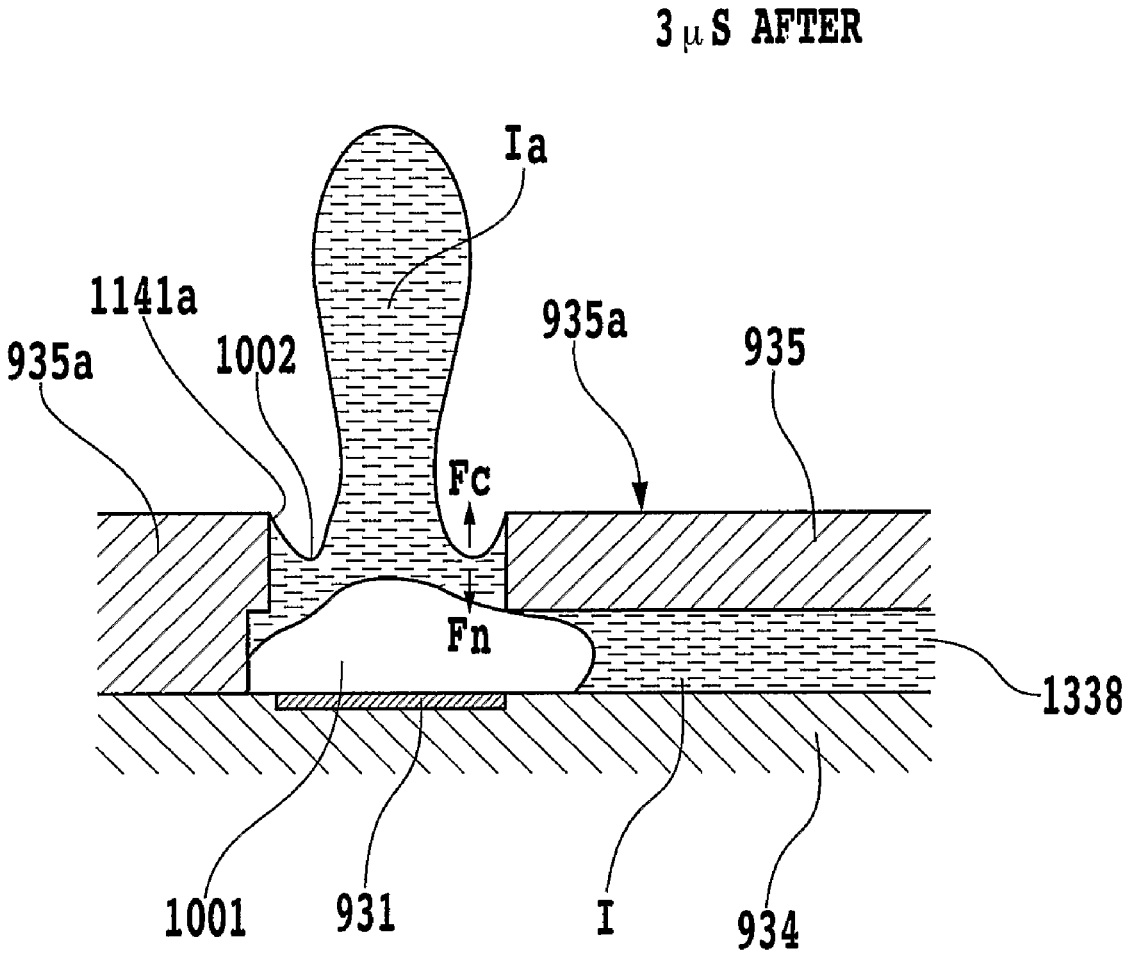
FIG. 7 is a cross-sectional view of the head showing an ejection operation with an elapse of time.
Figure 8:
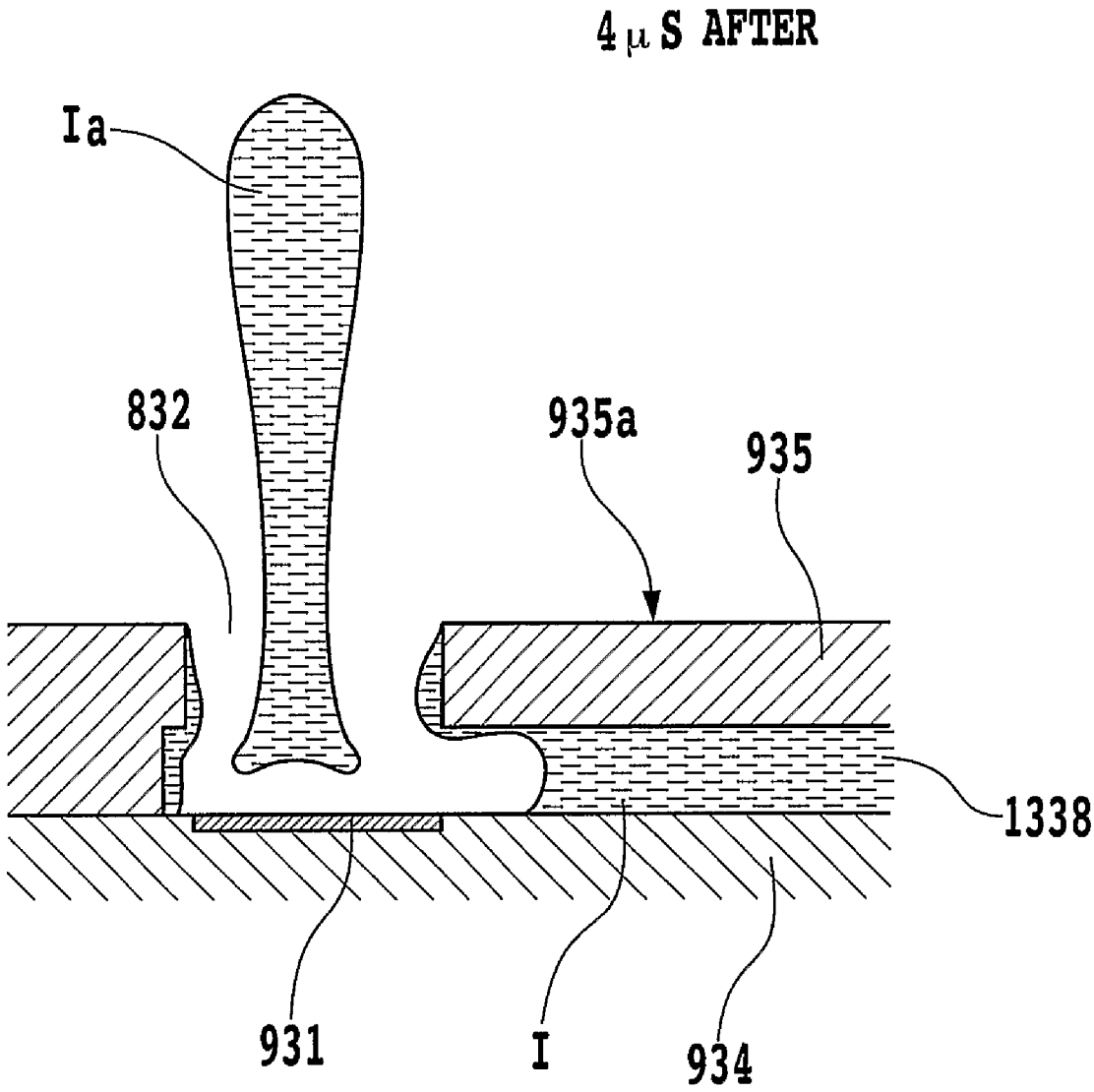
FIG. 8 is a cross-sectional view of the head showing an ejection operation with an elapse of time.
Figure 9:
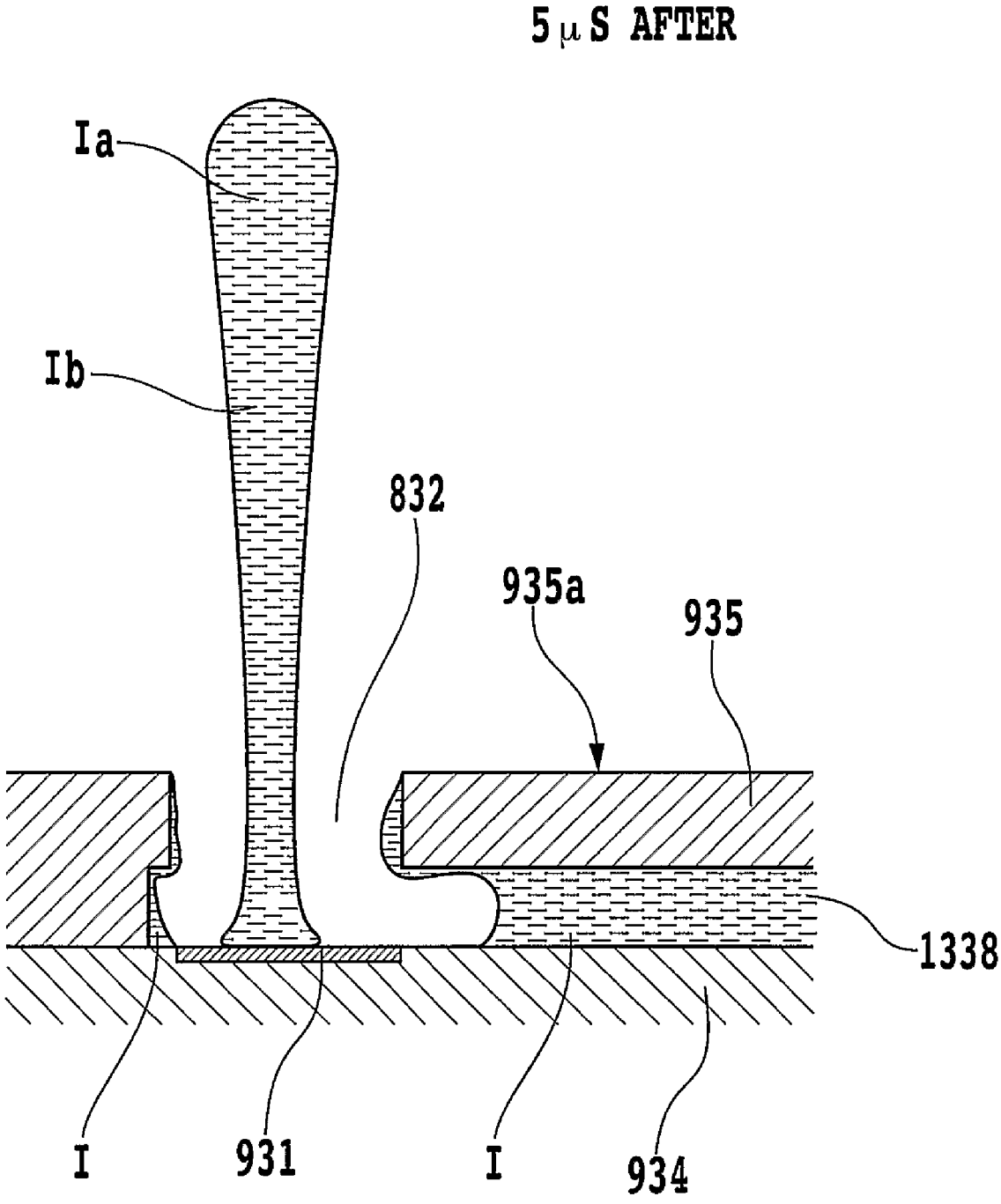
FIG. 9 is a cross-sectional view of the head showing an ejection operation with an elapse of time.
Figure 10:
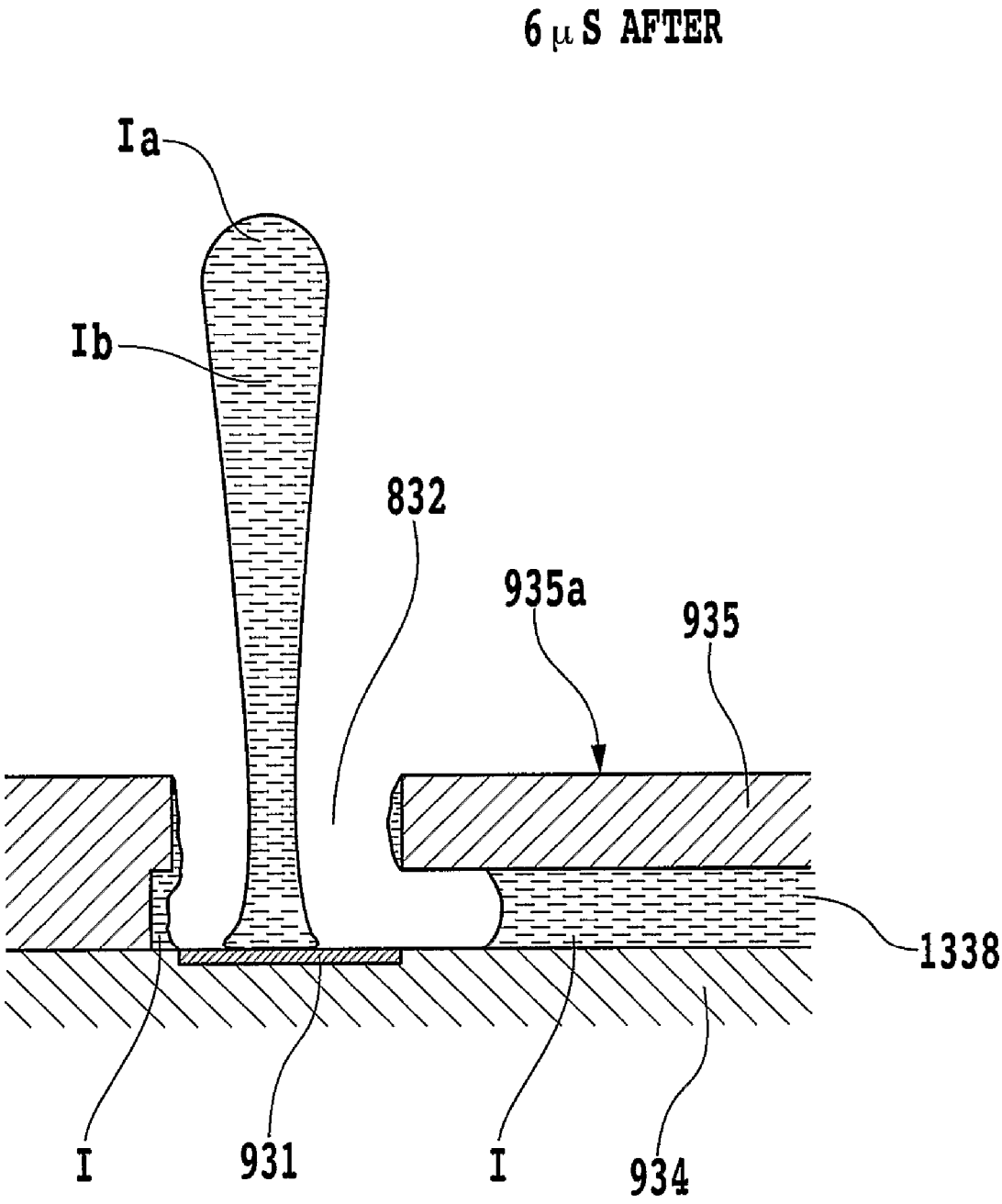
FIG. 10 is a cross-sectional view of the head showing an ejection operation with an elapse of time.
Figure 11:
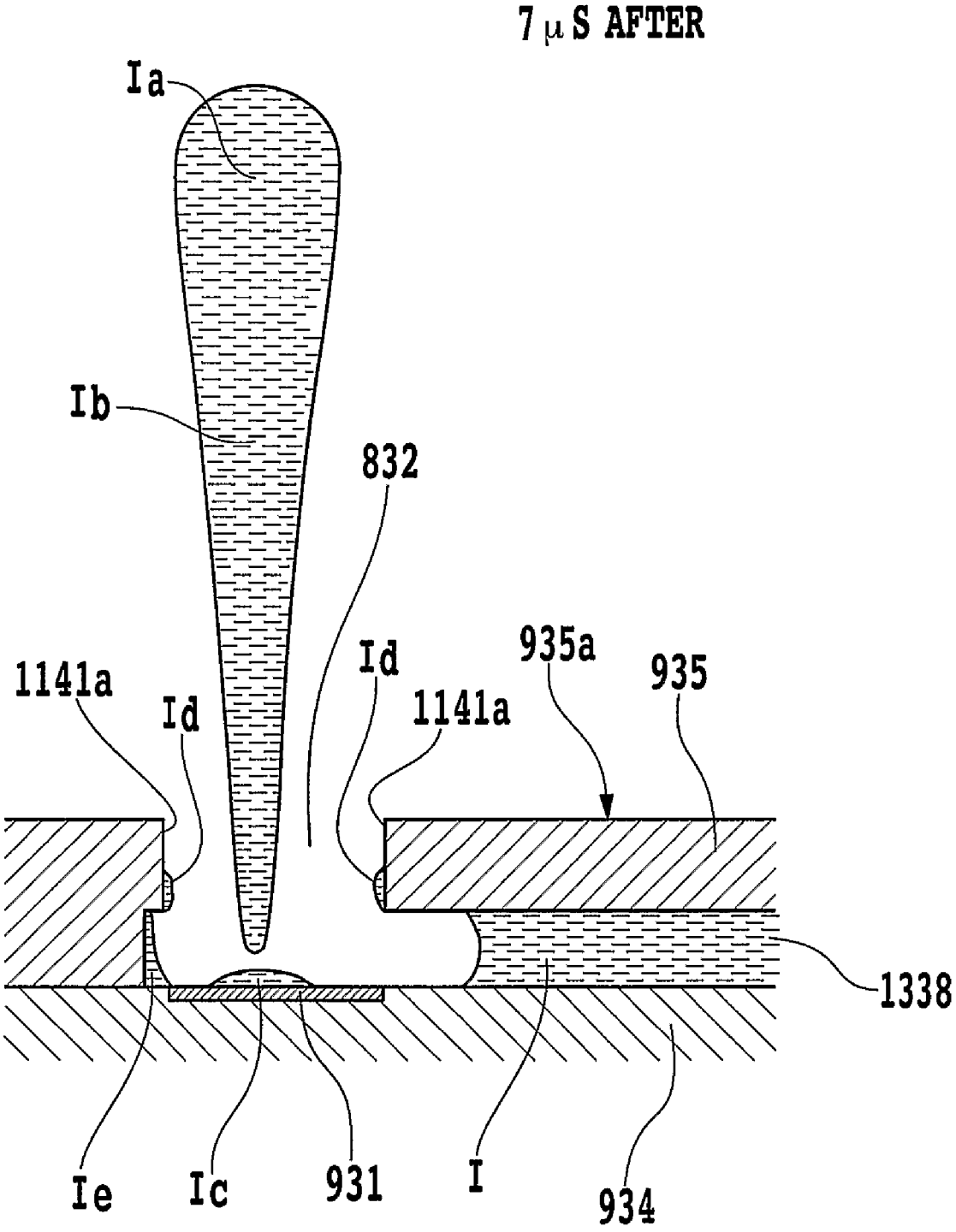
FIG. 11 is a cross-sectional view of the head showing an ejection operation with an elapse of time.

FIG. 4 shows a filmlike bubble being formed by the heater 931 as it is applied a pulse voltage. FIG. 5 shows a state about 1 μsec after the state of FIG. 4; FIG. 6 represents a state about 2 μsec later; FIG. 7 represents a state about 3 μsec later; FIG. 8 represents a state about 4 μsec later; FIG. 9 represents a state about 5 μsec later; FIG. 10 represents a state about 6 μsec later; and FIG. 11 represents a state about 7 μsec later. In the following explanation, words "drop or fall" or "allowed to fall" do not mean a fall in the gravitational direction but a movement toward the heater irrespective of the direction in which the head is mounted.

When the heater 931 is energized according to a print signal, a bubble 1001 is formed in a liquid path 1338 above the heater 931. The bubble 1001 rapidly expands as shown in FIG. 5 1 μsec later and FIG. 6 2 μsec later. When the bubble 1001 expands to its maximum volume, its height exceeds the nozzle surface 935*a*. The pressure of the bubble 1001 at this time is several to a dozen times smaller than the atmospheric pressure.

About 2 μsec after the generation of the bubble 1001, the bubble 1001 begins to decrease in volume and almost at the same time a meniscus 1002 begins to form. The meniscus 1002, as shown in FIG. 7, retracts toward the heater 931.

The falling speed of the meniscus 1002 is faster than the contracting speed of the bubble 1001. Therefore, about 4 μsec after the generation of a bubble, the bubble 1001 communicates with the atmosphere near the bottom surface of the nozzle 832 (FIG. 8). At the same time, the ink Ia near the center axis of the nozzle 832 begins to fall toward the heater 931. This is because the ink Ia that was pulled back toward the heater 931 by the negative pressure of the bubble 1001 before it communicated with the atmosphere still retains the speed toward the heater 931 surface by inertia even after the bubble has communicated with the atmosphere.

The ink Ia falling toward the heater 931 reaches the surface of the heater 931 about 5 μsec after the generation of the bubble 1001 (FIG. 9). Then, the ink spreads over the surface of the heater 931 (FIG. 10). The ink that has spread over the surface of the heater 931 has a horizontal vector along the surface of the heater 931 but a vector in a direction perpendicular to the surface of the heater 931 vanishes. Thus, the ink tends to stay on the surface of the heater 931. A portion of the liquid somewhat above the heater surface, which retains a speed vector toward the ejection direction, is acted upon by a downward force.

Then, a portion Ib between the bottom part of ink that has spread over the surface of the heater 931 and the upper part of ink (main droplet) narrows and, about 7 μsec after the generation of the bubble 1001, the liquid portion Ib is cut off at the center of surface of the heater 931 (FIG. 11). As a result, the ink is separated into the main droplet Ia having a speed vector in the ejection direction and the ink Ic spread over the surface of the heater 931. The cut position of Ib is located preferably inside the liquid path 1338 and more preferably on the heater 931 side rather than inside the nozzle 832 side.

The main droplet Ia thus generated is ejected from the central part of the nozzle 832 with no deviation in the ejection direction and lands at a target position on the print surface of the print medium. The ink Ic spread over the surface of the heater 931 stays on the heater surface and is not ejected.

Next, a pigment ink applicable to this embodiment will be explained. It is noted, however, that this invention is not limited to the example application of the pigment ink described below.

The pigment of the pigment ink used in this embodiment is 1-20% by weight of the total weight of the pigment ink and preferably 2-12 wt %. As a black pigment, carbon black may be used, which is made by the furnace method or channel method. It preferably has a first degree particle diameter of 15-40 mμ (nm), a BET method-based specific surface area of 50-300 $m^2/g$, a DBP absorbed oil volume of 40-150 ml/100 g, a volatile component of 0.5-10% and a pH value of 2-9. Products with the above characteristics available on the market include No. 2300, No. 900, MCF88, No. 33, No. 40, No.

45, No. 52, MA7, MA8, No. 2200B (these are from Mitsubishi Kasei), RAVEN1255 (Columbia make), REGAL400R, REGAL330R, REGAL660R, MOGUL L (these are from Cabot Corporation), Color Black FW1, Color Black FW18, Color Black S170, Color Black S150, Printex 35, Printex U (these are from Degussa).

Yellow pigments available on the market include, for example, C. I. Pigment Yellow 1, C. I. Pigment Yellow 2, C. I. Pigment Yellow 3, C. I. Pigment Yellow 13, C. I. Pigment Yellow 16, and C. I. Pigment Yellow 83.

Magenta pigments on the market include, for example, C. I. Pigment Red 5, C. I. Pigment Red 7, C. I. Pigment Red 12, C. I. Pigment Red 48 (Ca), C. I. Pigment Red 48 (Mn), C. I. Pigment Red 57 (Ca), C. I. Pigment Red 112, and C. I. Pigment Red 122.

Cyan pigments on the market include, for example, C. I. Pigment Blue 1, C. I. Pigment Blue 2, C. I. Pigment Blue 3, C. I. Pigment Blue 15:3, C. I. Pigment Blue 16, C. I. Pigment Blue 22, C. I. Vat Blue 4, and C. I. Vat Blue 6. In addition to these pigments, newly manufactured pigments, such as self dispersion type pigments, can of course be used.

Any type of pigment dispersant may be used as long as it is water-soluble resin. It preferably has a weight-averaged molecular weight of 1,000-30,000 and more preferably 3,000-15,000. More specifically, pigment dispersants include: block copolymers composed of at least two or more monomers (at least one of which is a hydrophilic polymeric monomer), which are selected from among styrene, styrene derivatives, vinylnaphthalene, vinylnaphthalene derivatives, aliphatic alcohol ester of $\alpha,\beta$-ethylenic unsaturated carboxylic acid, acrylic acid, acrylic acid derivatives, maleic acid, maleic acid derivatives, itaconic acid, itaconic acid derivatives, fumaric acid, fumaric acid derivatives, vinyl acetate, vinyl pyrrolidone, acrylamide, and its derivatives; random copolymers; graft copolymers; or their salts. Further, natural resins such as rosin, shellac and starch may also be used in a preferable condition. These resins can be dissolved in a water solution of bases and are alkaline soluble resins. These water-soluble resins used as a pigment dispersant in the pigment ink preferably have a content of 0.1-5 wt % of the total weight of pigment ink.

In the case of a pigment ink containing the above pigments, the whole pigment ink is preferably adjusted to be neutral or alkaline. This improves the solubility of water-soluble resins used as a pigment dispersant and thus provides a pigment ink with an excellent long-term storage capability. In this case, however, since the alkaline liquid may corrode a variety of members used in the ink jet printing apparatus, it is desired that the pigment ink be adjusted in a pH range of 7-10. Possible pH adjusting agents include, for example, organic amines such as diethanolamine and triethanolamine, inorganic alkali agents such as hydroxides of alkaline metals, including sodium hydroxide, lithium hydroxide and potassium hydroxide, and organic acids and mineral acids. The above pigments and the water-soluble resins used as dispersants are dispersed or dissolved in a water-soluble medium.

In the pigment ink of this embodiment, the suitable aqueous liquid medium is a mixed solvent of water and water-soluble organic solvent. In this case, ion-exchanged water (deionized water) is preferably used, rather than commonly available water containing various ions.

The water-soluble organic solvents that are mixed with water include, for example, alkylalcohols with a carbon number of 1-4, such as methylalcohol, ethylalcohol, n-propylalcohol, isopropylalcohol, n-butylalcohol, sec-butylalcohol, and tert-butylalcohol; amides such as dimethyl formamide and dimethyl acetamide; ketones or ketoalcohols such as acetone and diacetone alcohol; ethers such as tetrahydrofuran and dioxane; polyalkyleneglycols such as polyethyleneglycol and polypropyleneglycol; alkyleneglycols with alkylene group having 2-6 carbon atoms, such as ethyleneglycol, propyleneglycol, butyleneglycol, triethyleneglycol, 1,2,6-hexanetriole, thiodiglycol, hexyleneglycol, and diethyleneglycol; glycerin; lower alkylethers of polyvalent alcohols such as ethyleneglycol monomethyl (or ethyl) ether, diethyleneglycol methyl (or ethyl) ether, and triethyleneglycol monomethyl (or ethyl) ether; and N-methyl-2-pyrrolidone, 2-pyrrolidone, and 1,3-dimethyl-2-imidazo-lidinone. Of these many water-soluble organic solvents, polyvalent alcohols such as diethyleneglycol and lower alkylethers of polyvalent alcohols such as triethyleneglycol monomethyl (or ethyl) ether are suitably applied.

A content of the above water-soluble organic solvents in the pigment ink is generally in a range of 3-50 wt % of the total weight of the pigment ink and more preferably in a 3-40 wt % range. A water content is 10-90 wt % of the total weight of the pigment ink and preferably 30-80 wt %.

To provide the pigment ink of this embodiment with desired properties, surfactant, antifoaming agent and preservative may be added to the pigment ink as required. It is strongly desired that a proper amount of surfactant that facilitates a quick soaking of a liquid component of the pigment ink into the print medium be added. The amount to be added is 0.05-10 wt % or more preferably 0.5-5 wt %. As for anionic surfactant, commonly available surfactants can suitably be used, such as carboxylate type, sulfate ester type, sulphonate type and phosphate type.

The above pigment ink may be made as follows. First, to an aqueous medium containing a water-soluble resin as dispersant and water, the above pigment is added and stirred. Then, a dispersing means described later is used to disperse the pigment and a centrifugal separation may be performed as required to obtain a desired dispersed liquid. Next, to this dispersed liquid, a sizing agent and suitably selected additive components described above are added and stirred to produce a pigment ink.

When an alkali-soluble type resin is used as a dispersant, a base needs to be added in order to dissolve the resin. The bases that are preferably used are organic amines, such as monoethanolamine, diethanolamine, triethanolamine, aminomethylpropanol and ammonia, or inorganic bases such as potassium hydroxide and sodium hydroxide.

In the method of making a pigment ink containing a pigment, an aqueous medium containing the pigment is stirred and, prior to dispersion processing, it is effective to perform a mixing for more than 30 minutes. This is because the premixing operation improves a wettability on the pigment surface and promotes adsorption of the dispersant onto the pigment surfaces.

The dispersing machine used during the pigment dispersing processing may be any type of commonly used machine, for example, a ball mill, roll mill and sand mill. Of these the high-speed sand mill is preferably used. Such machines include, for example, Super mill, Sand grinder, Beads mill, Agitator mill, Glen mill, Dyno-mill, Pearl mill and Cobol mill (all tradenames).

Ink jet printing apparatus applying pigment inks in general select pigments with an optimum grain size distribution to prevent clogging of nozzles as much as possible. To obtain a desired grain size distribution may involve reducing the size of crushing media in the dispersing machine, increasing a charge ratio of the crushing media, prolonging a processing time, slowing an ejection speed, and classifying crushed grains by filter and centrifugal separator. These methods may also be combined as required.

Next, a reaction liquid applicable in this embodiment that reacts with the above pigment ink will be explained. In this specification, the reaction liquid is defined to be a liquid having a component that acts to coagulate a colorant contained in ink. If a pigment ink is used which contains a pigment dispersed by an electric repelling force, the reaction liquid suitably includes a polyvalent metal salt which is a reaction component that eliminates this electric repelling force. The polyvalent metal salt is composed of divalent or higher metal ions and anions that combine with these polyvalent metal ions. Examples of polyvalent metal ions include divalent metal ions such as $Ca^{2+}$, $Cu^{2+}$, $Ni^{2+}$, $Mg^{2+}$ and $Zn^{2+}$, and trivalent metal ions such as $Fe^{3+}$ and $A1^{3+}$. Examples of anions include $Cl^{-}$, $NO^{3-}$ and $SO^{4-}$. To make the reaction occur instantaneously to quickly form a coagulated film, it is desired that a total electric charge concentration of polyvalent metal ions in the reaction liquid be more than twice that of ions of opposite polarity contained in the coloring pigment ink.

Water-soluble organic solvents that can be used as a reaction liquid include, for example, amides such as dimethylformaldehyde; ketones such as acetone; ethers such as tetrahydroflane and dioxane; polyalkyleneglycols such as polyethyleneglycol and polypropyleneglycol; alkyleneglycols such as ethyleneglycol, propyleneglycol, butyleneglycol, triethyleneglycol, 1,2,6-hexanetriole, thiodiglycol, hexyleneglycol and diethyleneglycol; lower alkylethers of polyvalent alcohol of ethyleneglycol methylether, diethyleneglycol monomethylether and triethyleneglycol monomethylether; monovalent alcohols such as ethanol, isopropylalcohol, n-butylalcohol and isobutylalcohol; and glycerin, N-methyl-2-pyrrolidone, 1,3-dimethyl-imidazolydinone, triethanolamine, sulfolane, and dimethylsulfoxide. Although there is no particular limitations on the content of the above water-soluble organic solvent in the reaction liquid, it is preferably 5-60 wt % of the total weight of the reaction liquid and more preferably 5-40 wt %.

To the reaction liquid, additives such as viscosity adjusting agent, pH adjusting agent, preservative and antioxidant may be added as required. The selection of surfactant that functions as a penetration accelerator and the amount of surfactant as additive requires caution in restricting the penetrability of the reaction liquid into the print medium. Although the reaction liquid is preferably colorless, it may be light-colored to such a degree that it will not change the tone of the coloring inks when it is mixed with the inks on the print medium. Further, the properties of the above reaction liquid are preferably adjusted so that its viscosity at around 25° C. is in a range of 1-30 cps.

Example components and features of the reaction liquid applicable to this embodiment have been described. It is noted, however, that the use of the reaction liquid for coagulating the colorant is not essential in this invention. This is because the effect of this invention can be produced by using a colorant that has a tendency to coagulate on the print medium without reacting with the reaction liquid and also by using a coagulation inhibitor explained below which is characterized by the ability to prevent the coagulation. However, the reaction of the colorant with the reaction liquid is considered likely to augment the desired effect on the image quality improvement and on the resolution of the problem that the invention is intended to solve. So, the use of the reaction liquid as in this embodiment can take advantage of the feature of this invention more effectively.

Figure 12:
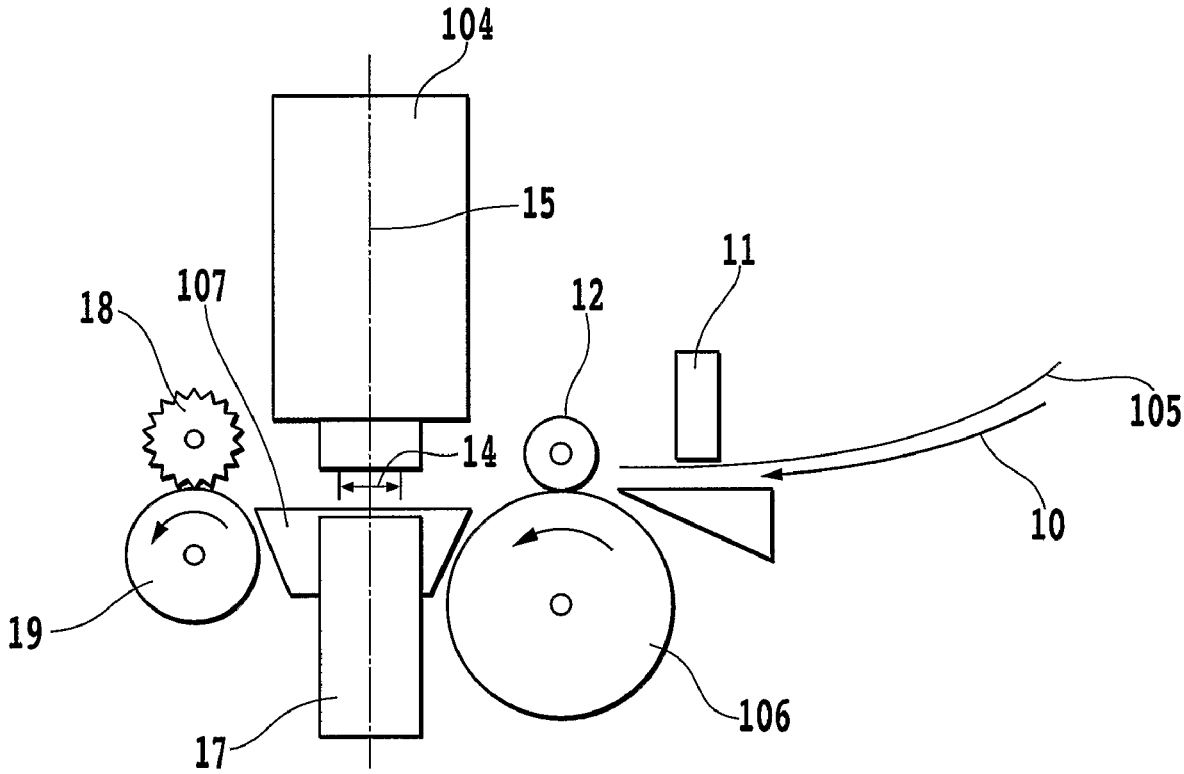
FIG. 12 is a cross-sectional view showing a detail of a printing unit in the printing apparatus of the embodiment of this invention.
Figure 13:
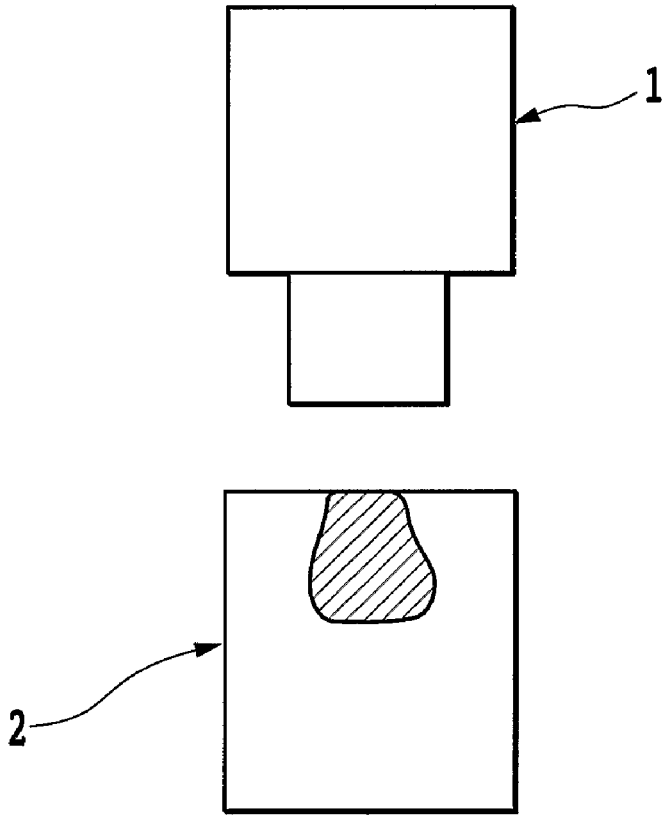
FIG. 13 is a schematic diagram showing a dye ink ejected onto an absorber.
Figure 14:
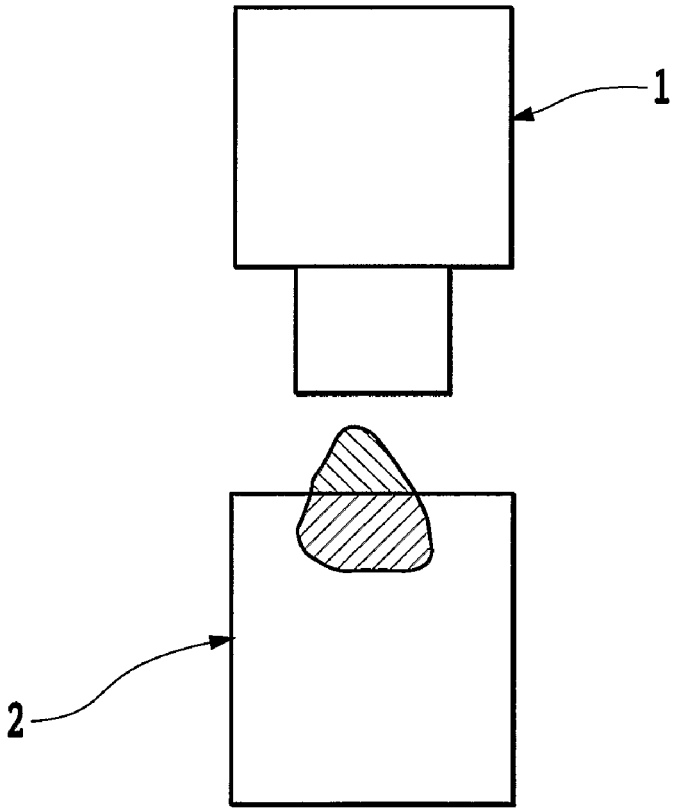
FIG. 14 is a schematic diagram showing a pigment ink ejected onto the absorber.

FIG. 12 is a cross-sectional view showing details of the printing unit in the printing apparatus of this embodiment. denoted 10 is a transport path of the print medium. When a print start instruction is issued, the print medium 105 is fed in the direction of arrow along the transport path 10. Designated 11 is a paper sensor. The paper sensor 11 detects the presence or absence of the print medium 105 to determine whether the paper feed operation has been done normally. In the case of the "marginless printing," the front end of the print medium 105 is detected and, based on this timing, the distance that the print medium is transported and the printing method can be controlled. The front end of the print medium thus transported is held between a pinch roller 12 and a transport roller 13 and in this state is transported to below the print head 1 by the rotation of the transport roller 13 and then is positioned at the center 15.

A printable area 14 represents an area where the printing operation is performed by using a plurality of nozzles arrayed on the print head 104. The center position 15 represents the center of the printable area 14. The print medium 105 transported here is supported from below by the platen 107 so that an appropriate distance is kept between the print medium and the nozzle surface. The platen 107 has a hole at the central part thereof facing the printable area 14 of the print head 104. An ink absorber 17 is provided at the hole position as shown.

The print medium with its front end positioned at the center 15 is subjected to a first scan by the print head 104. In the case of the "marginless printing" ink droplets ejected outside the edges of the print medium 105 are absorbed into the ink absorber 17 installed at the center of the platen.

After one printing scan is executed, the print medium is fed a predetermined distance to an area where the next printing scan is to be performed. By repetitively alternating the printing scan and the print medium feeding, an image is formed progressively on the print medium. The print area of the print medium is held between a spur 18 and a discharge roller 19 and moved toward a paper discharge unit. When the paper sensor 11 detects the rear end of the print medium as the printing operation proceeds, a predetermined number of transport operations are performed, at which time the rear end of the print medium is situated directly below the printable area. Then, the rear end is printed in a way similar to that of the front end, with the ink ejected outside the rear edge of the print medium absorbed into the ink absorber 17 installed at the center of the platen.

Figure 16:
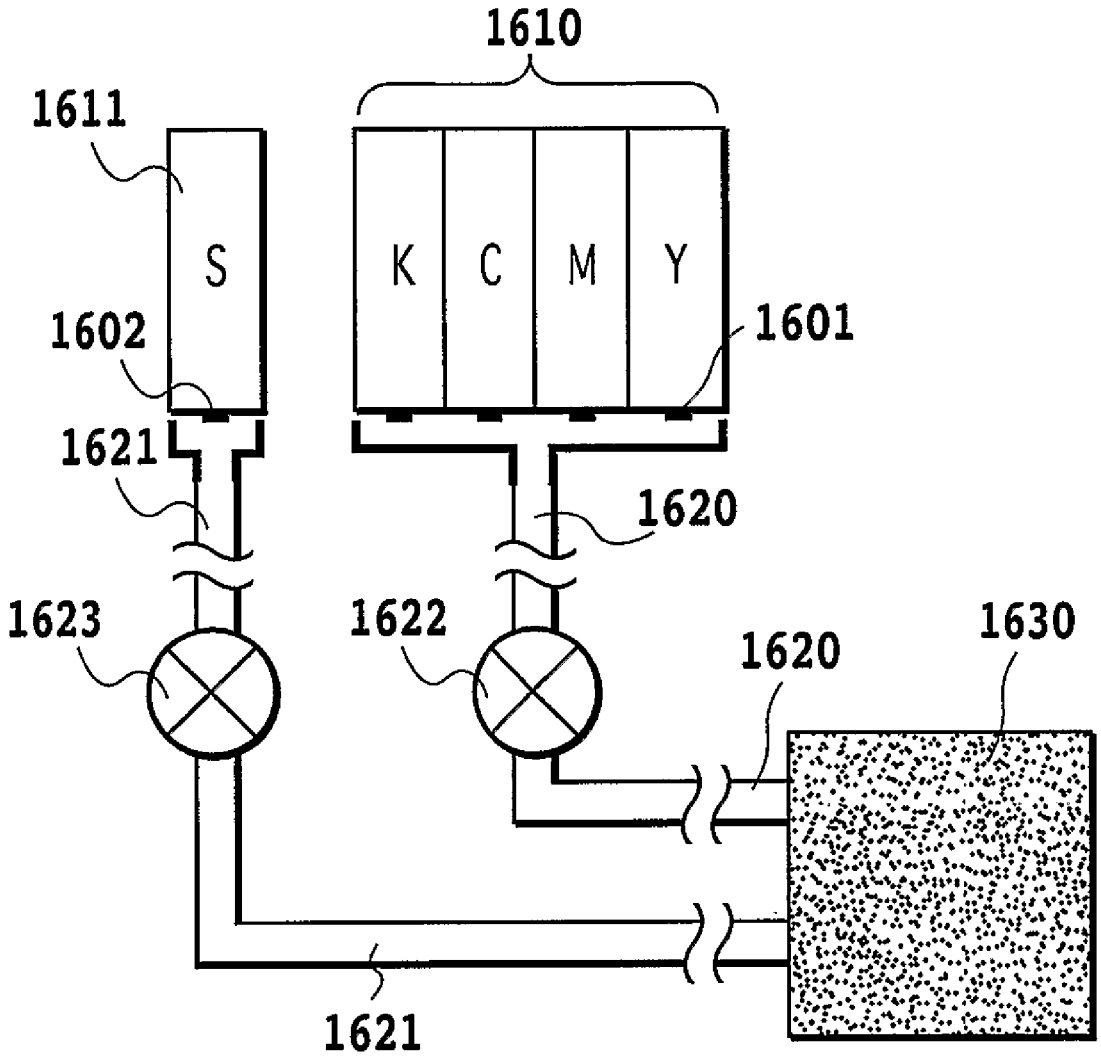
FIG. 16 is a schematic diagram showing an example construction of a suction-based recovery means in the first embodiment of this invention.

FIG. 16 is a schematic diagram showing an example construction of a suction-based recovery means applicable to this embodiment. In the figure, denoted 1610 are print heads to eject inks. Designated 1611 is another print head to eject a reaction liquid. While in the cross section of FIG. 12, they are described generally as the print head 104, the print heads of different colors are actually provided independently of each other as shown in FIG. 16. In this embodiment, the print heads 1610 for inks and the print head 1611 for reaction liquid are subjected to the suction operation by independent suction pumps 1622 and 1623. Thus, the inks are sucked out from the nozzles 1601 of the ink print heads 1610 and the reaction liquid from the nozzles 1602 of the reaction liquid print head 1611. Then, the inks reach the waste ink absorber 1630 through the tube 1620. The reaction liquid reaches the waste ink absorber 1630 through the tube 1621.

Although the coloring inks used here are four colors K, C, M, Y, this embodiment is not limited to this ink combination and it is possible to add light color inks of, for instance, C and M.

The invention and this embodiment are characterized by the fact that the ink absorber 17, the waste ink absorber 1630 and the preliminary ejection pad installed in the maintenance means 109 contain a coagulation inhibitor.

The material of the absorber and the coagulation inhibitor applicable to the invention and this embodiment will be explained in the following.

In this specification, the "absorber (or ink absorber)" refers to at least one of the ink absorber for "marginless printing", the waste ink absorber and the preliminary ejection pad. The "absorber (or ink absorber)" in this specification is intended to absorb inks discharged from the print heads. Here, the "inks discharged from the print heads" include inks ejected from the print heads during the preliminary ejection and inks sucked out from the print head by the suction-based recovery means. That is, the "discharging" includes a sucking-out operation and an ejection operation.

There is no special requirement for the material of the absorber applicable to this embodiment, except that it need only have a function of holding a liquid in an appropriate manner. Appropriate materials can be chosen for the ink absorber for "marginless printing", the waste ink absorber and the preliminary ejection pad according to their roles. For example, a material made of porous material and fiber material such as sponge and one made of a high molecular absorber or of a paperlike material mixed with a high molecular absorber are suitable for the ink absorber for "marginless printing" and for the waste ink absorber. If the absorber made of a fiber material is used, a liquid can better be guided by arranging the absorber so that fibers are aligned in one direction from a waste liquid dripping point toward a connecting portion. A felt-like material is also suitable for use.

Figure 20A:
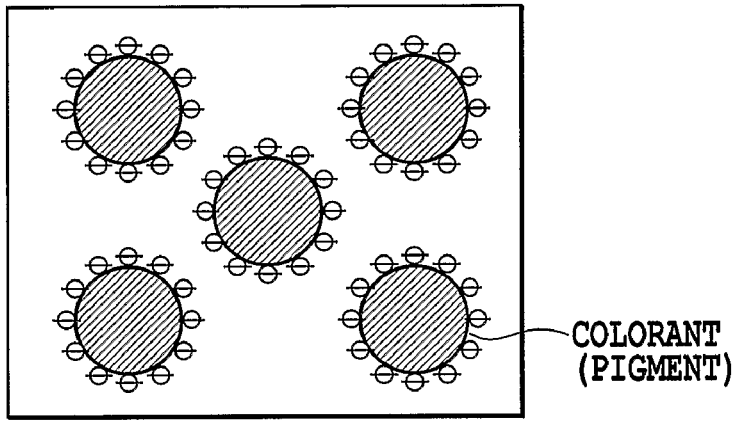
FIGS. 20A to 20C are diagrams explaining an effect of steric hindrance caused by a coagulation inhibitor.
Figure 20B:
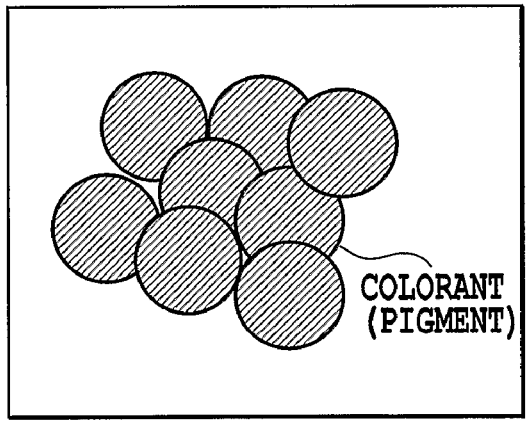

Next, a coagulation inhibitor applicable to this embodiment will be explained. FIG. 20 shows an effect of steric hindrance brought about by the coagulation inhibitor. As shown in FIG. 20A, the colorant (pigment) particles are dispersed in the liquid by electric repulsive force. Before the pigment ink is discharged from the print head (as by ejection operation or suction operation), namely, when the pigment particles are in the liquid, their state is as shown in FIG. 20A. When the pigment ink is discharged from the print head and introduced into the absorber, a dielectric constant of the liquid decreases as a result of penetration and evaporation of the liquid and thus electric repulsive force among pigment particles becomes small. Therefore the pull among the pigment particles due to van der Waals' force is stronger than the electric repulsive force, with the result that the pigment particles coagulate and stay near the surface of the absorber (FIG. 20B) while the liquid penetrates into the interior of the absorber. Solid materials are separated from the liquid in this way.

Figure 20C:
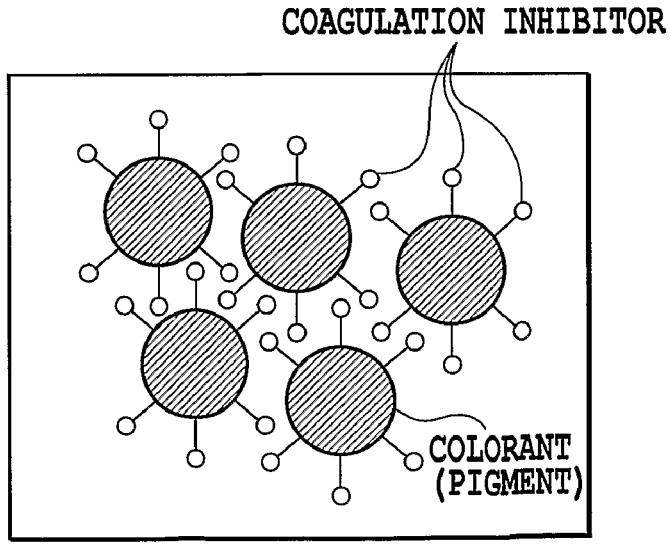

To prevent this phenomenon, this embodiment uses a coagulation inhibitor that acts to block contact among the pigment particles (this is hereinafter referred to as an effect of steric hindrance) to minimize the coagulation of colorant near the absorber surface and therefore the stagnation of colorant near the absorber surface. More specifically, a coagulation inhibitor is prepared which can adsorb to the surface of the pigment particles and act to block the pigment particles from contacting one another, as shown in FIG. 20C, and this material is contained in the absorber. Then, when a pigment ink is introduced into the absorber, the coagulation inhibitor adsorbs to the surface of the pigment particles preventing the contact among the pigment particles. Thus, the pigment particles can remain dispersed in a stable condition, not dependent on the penetration and evaporation of the liquid. It is therefore less likely for the pigment particles to coagulate, minimizing the stagnation of colorant near the absorber surface.

As described above, this embodiment can use as a coagulation inhibitor a material that can disperse colorant particles by the effect of steric hindrance. Examples of applicable materials include nonionic surfactant BC40 (Nikko Chemical make), BC20 (Nikko Chemical make). Particularly nonionic surfactant with five or more ethyleneoxide groups can be effectively used.

When a reactive ink is used, the reaction and coagulation of the colorant can also be inhibited by making polyvalent metal ions contained in the reaction liquid insoluble in the ink. Examples of such materials include alkaline water solutions such as sodium hydroxide, lithium hydroxide and magnesium hydroxide. It is also possible to use a chelating agent that masks a particular metal. Example chelating agents include EDTA (ethylenediaminetetraacetic acid), NTA (nitrilotriacetic acid) and UDA (uramildiacetic acid).

It is noted, however, that the coagulation inhibitor applicable in this invention is not limited to those having the above three-dimensional barrier effect or those capable of preventing the polyvalent metal salt in the reaction liquid from being dissolved. In effect, the coagulation inhibitor needs only to be able to inhibit the coagulation of a colorant that tends to coagulate. So, it does not matter whether the means employed takes advantage of the three-dimensional barrier effect, chemical reactions or other chemical effects.

The absorbers in this embodiment, i.e., the ink absorber for "marginless printing", the waste ink absorber and the preliminary ejection pad, are manufactured by immersing them in a solution of the coagulation inhibitor and drying a medium of the solution. These three kinds of ink absorbers may of course use different kinds of absorbing materials and coagulation inhibitors.

The effect of the above construction will be explained. First, in the case of the ink absorber 17, when the "marginless printing" is performed, the colorant particles do not coagulate on the surface of the absorber and keeps its fluid state. That is, the colorant particles penetrate into the ink absorber 17 and do not deposit on the absorber surface. As a result, the problems accompanied by the execution of "marginless printing" that are explained in the "Description of the Related Art", such as a contamination of an interior of the printing apparatus, a contamination of a back of a print medium and an improper transport of the print medium due to ink deposit, can be solved or minimized. This absorber is effective for the prevention of coagulation both when a pigment ink is used and when a reaction liquid is used.

Figure 15A:
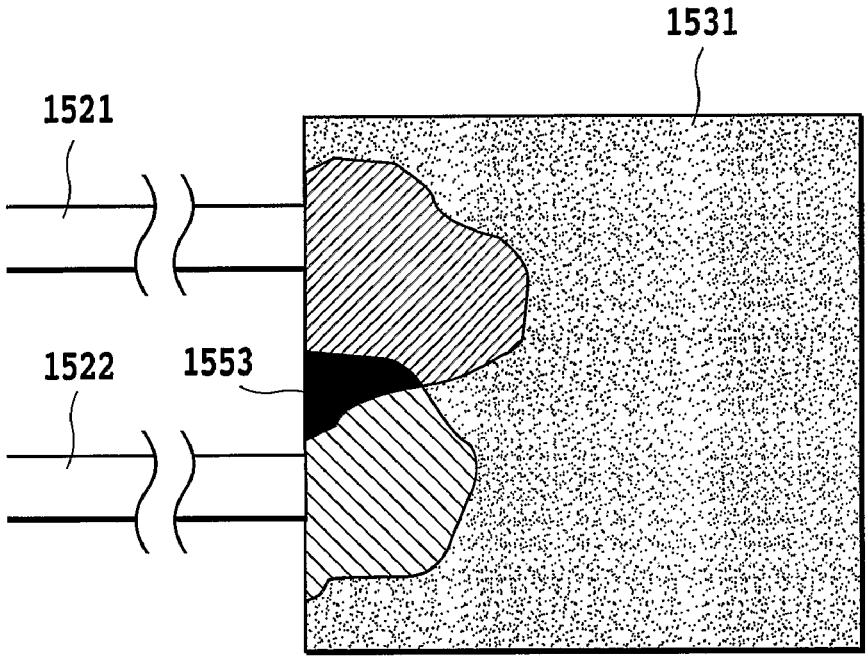
FIGS. 15A and 15B are schematic diagrams showing a problem with the waste ink absorber caused by the coagulation of ink.
Figure 15B:
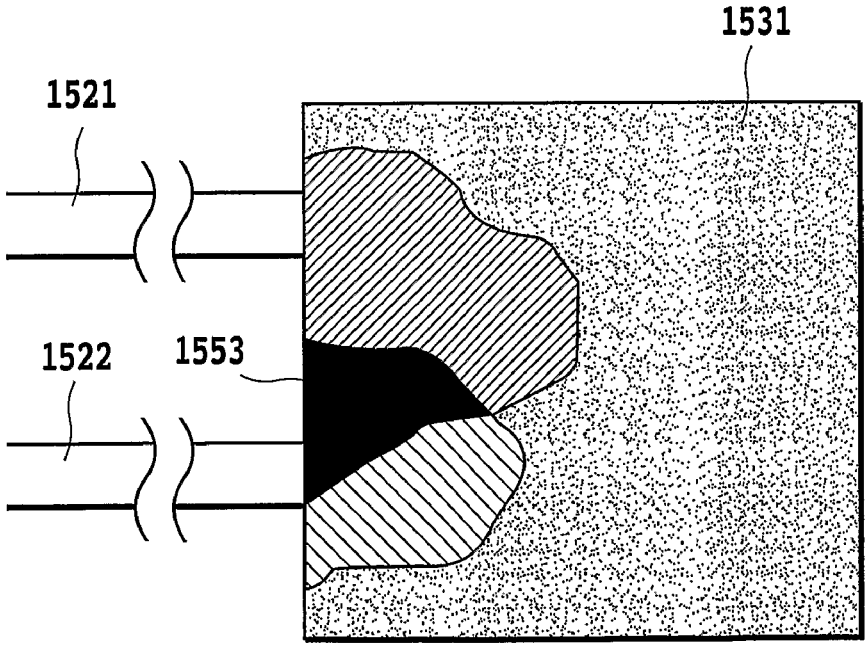
Figure 17A:
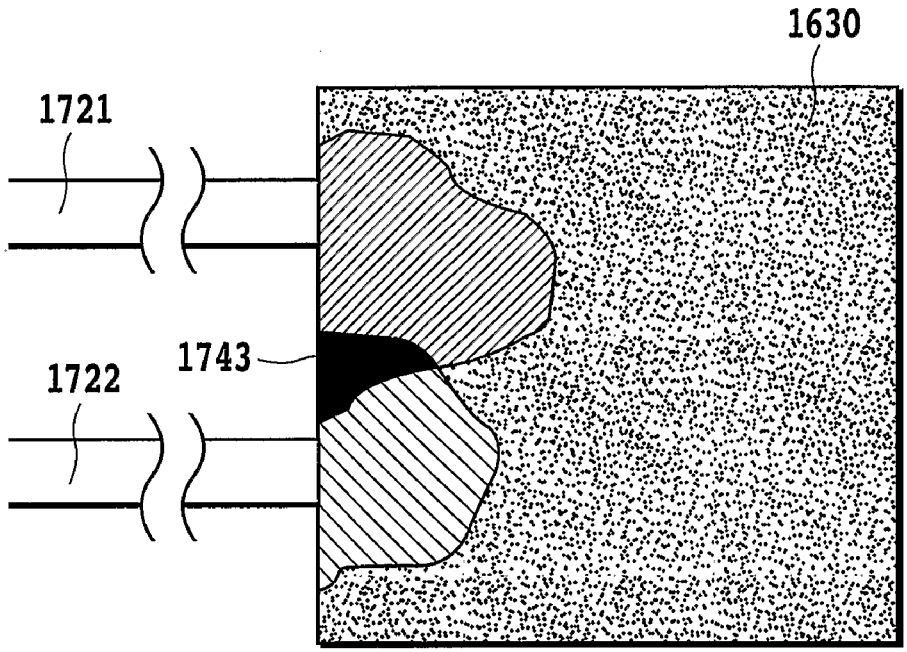
FIGS. 17A and 17B are schematic diagrams showing the effect this invention has on the waste ink absorber.
Figure 17B:
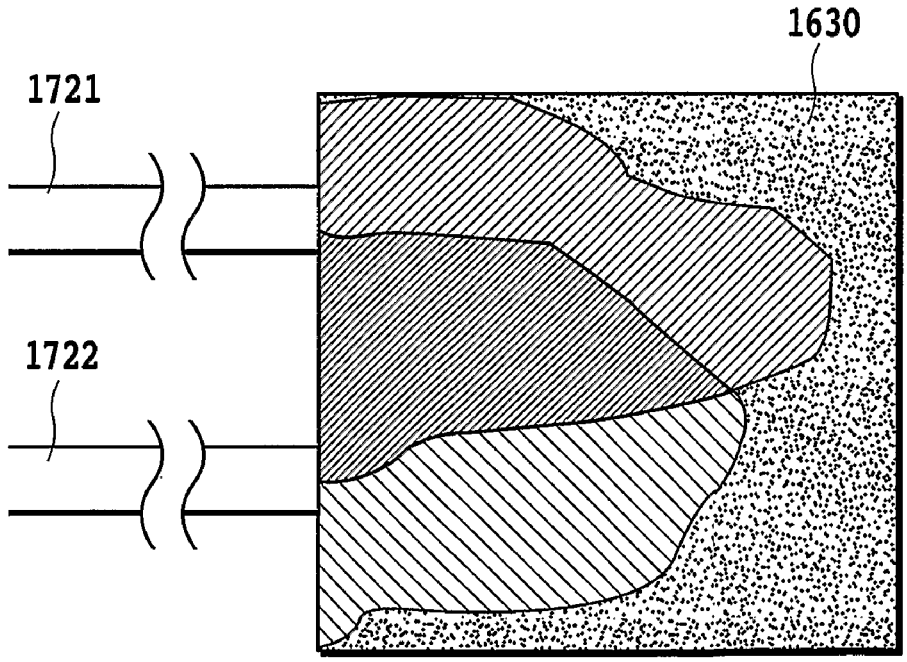

FIGS. 17A and 17B are schematic diagrams showing the coagulation inhibition effect of the waste ink absorber 1630 in this embodiment. For comparison with FIGS. 15A and 15B, here is shown a case in which inks coagulate by reacting with the reaction liquid. In the figure, denoted 1721 is a tube for inks and 1722 a tube for the reaction liquid. Waste liquids transported through these tubes are absorbed into the waste ink absorber 1630 of this embodiment. The waste ink absorber 1630 is soaked with a coagulation inhibiting liquid beforehand. Therefore, the reaction or coagulation in the mixing portion 1743 of the inks and the reaction liquid is inhibited, forming almost no coagulates or insoluble substances or such a stagnant region as shown in FIGS. 15A and 15B. That is, in the entire area of the absorber where the waste liquid is absorbed, the liquid can keep its fluidity. Thus, if the inflow of waste liquid increases as the suction operation is repeated, the inflow areas are not blocked, as they are in the case of FIGS. 15A and 15B. This means that the continued use of the absorber will not result in any trouble with the suction operation.

To keep the performance of the coagulation inhibitor in good condition for as long as possible, the absorbers may be provided with a means, though not shown here, for supplying the coagulation inhibitor to the absorbers as required. The coagulation inhibitor is preferably supplied immediately after the power-on of the printing apparatus, or at predetermined intervals, or each time the ink is discharged to the absorbers (in this example, each time the marginless printing is executed, each time the preliminary ejection operation is executed, or each time the suction-based recovery operation is executed).

Examples for verification and comparison implemented by the inventors of this invention to confirm the effects of this invention will be explained in the following. In the following description, parts and percent are based on weight unless otherwise specifically stated.

(Verification 1)

According to a process described below, pigment inks of black, cyan, magenta and yellow containing pigments and anionic compounds were produced. A coagulation inhibiting liquid was also made.

(Coloring Ink K1)

<Making Pigment Dispersion Liquid>

| | |
|---|---|
| Styrene-acrylic acid-ethylacrylate copolymer (acid value 240, weight-averaged molecular weight = 5,000) | 1.5 parts |
| Monoethanolamine | 1.0 part |
| Diethyleneglycol | 5.0 parts |
| Ion-exchanged water | 81.5 parts |

The above components were mixed together and heated to 70° C. in water bath to completely dissolve resin component. To this solution, 10 parts of newly prepared carbon black (MCF88, Mitsubishi Kasei make) and one part of isopropylalcohol were added; and they were subjected to 30 minutes of premixing and then to dispersion processing under the following conditions.

Dispersion machine: sand grinder (Igarashi Kikai make)

Crushing media: zirconium beads 1 mm in diameter

Charging factor of crushing media: 50% (by volume)

Crushing time: 3 hours

They were also subjected to a centrifugal separation process (12,000 rpm for 20 minutes) to remove coarse particles to make a pigment-dispersed liquid.

<Making Coloring Ink K1>

Using the above dispersion liquid, components having the following composition ratio were mixed to manufacture an ink containing a pigment for use as a coloring ink.

| | |
|---|---|
| The above pigment-dispersed liquid | 30.0 parts |
| Glycerin | 10.0 parts |
| Ethyleneglycol | 5.0 parts |
| N-methylpyrrolidone | 5.0 parts |
| Ethylalcohol | 2.0 parts |
| Acetylenol EH (Kawaken Fine Chemical) | 1.0 part |
| Ion-exchanged water | 47.0 parts |

(Coloring Ink C1)

10 parts of carbon black (MCF88, Mitsubishi Kasei make) used to make the coloring ink K1 was replaced with Pigment Blue 15 to make a coloring ink C1 in the same way as manufacturing the coloring ink K1.

(Coloring Ink M1)

10 parts of carbon black (MCF88, Mitsubishi Kasei make) used to make the coloring ink K1 was replaced with Pigment Red 7 to make coloring ink M1 in the same way as manufacturing the coloring ink K1.

(Coloring Ink Y1)

10 parts of carbon black (MCF88, Mitsubishi Kasei make) used to make the coloring ink K1 was replaced with Pigment Yellow 74 to make coloring ink Y1 in the same way as manufacturing the coloring ink K1.

(Coagulation Inhibiting Liquid P1)

The following components were mixed and dissolved and then filtered under pressure by a membrane filter with a pore size of 0.22 μm (product name: Floropore Filter, Sumitomo Denko make) to produce a coagulation inhibiting liquid P1.

<Composition of Coagulation Inhibiting Liquid P1>

| | |
|---|---|
| Methylalcohol | 5.0 parts |
| BC40 (Nikko Chemical make) | 15.0 parts |
| Ion-exchanged water | 80.0 parts |

Next, the four ink absorbers (an absorber for marginless printing, two preliminary ejection pads, and a waste ink absorber) were taken out from PIXUS990i (Canon make) and dipped in a coagulation inhibiting liquid P1 for 10 minutes and then dried in an oven. At this time, the ink absorber for "marginless printing" was dried at 60° C. for six hours and the waste ink absorber at 70° C. for 24 hours. After being dried the ink absorbers were put back in PIXUS990i to complete an ink jet printing apparatus mounted with the ink absorbers of this embodiment.

Then, a pigment ink Y1 was poured into an ink tank BCI-6PM (Canon make), a pigment ink M1 into an ink tank BCI-6R (Canon make), a pigment ink C1 into an ink tank BCI-6BK (Canon make), and a pigment ink K1 into an ink tank BCI-6PC (Canon make). After this, the four ink tanks filled with inks were mounted on a tank holder of PIXUS990i so that inks could be ejected from the print heads. Other ink tanks BCI-6C, BCI-6M and BCI-6Y were installed empty.

Then, an "overrunning width for marginless printing" was set to 5 mm and a professional photopaper of 2L size (PR101 2L, Canon make) was chosen as a print medium. A sample image ISO/JIS-SCID (N3 fruit) was printed on 500 sheets continuously. No pigment ink was found deposited on the ink absorber. Therefore, the back of the print medium was not contaminated, nor was any print medium transport anomaly observed.

With a head refreshing selected in the property window of the printer driver, 500 suction-based recovery operations and preliminary ejection operations were performed. Satisfactory and reliable performance was confirmed in every operation. After the test, a check on the waste ink absorber and the preliminary ejection pads found no ink stagnating area or any closed waste ink path due to coagulates.

(Verification 2)

A reaction liquid S1 to facilitate the coagulation of coloring inks K1, C1, M1, Y1 was made in the following process.

(Reaction Liquid S1)

The following components were mixed and dissolved and then filtered under pressure by a membrane filter with a pore size of 0.22 μm (product name: Floropore Filter, Sumitomo Denko make) to produce a reaction liquid S1 with its pH adjusted to 3.8.

<Composition of Reaction Liquid S1>

| | |
|---|---|
| Diethyleneglycol | 10.0 parts |
| Methylalcohol | 5.0 parts |
| Magnesium nitrate | 3.0 parts |
| Acetylenol EH (Kawaken Fine Chemical) | 0.1 part |
| Ion-exchanged water | 81.9 parts |

Four ink absorbers for PIXUS990i were manufactured in a way similar to Verification 1 to complete an ink jet printing apparatus mounted with the ink absorbers of this embodiment.

The reaction liquid S1 was poured into an ink tank BCI-6C, a pigment ink Y1 into an ink tank BCI-6PM (Canon make), a pigment ink M1 into an ink tank BCI-6R (Canon make), a pigment ink C1 into an ink tank BCI-6BK (Canon make), and a pigment ink K1 into an ink tank BCI-6PC (Canon make). Further, the five ink tanks filled with inks were mounted on a tank holder of PIXUS990i so that inks could be ejected from the print heads. Other ink tanks BCI-6M and BCI-6Y were installed in an empty state. Then, two waste liquid tubes in PIXUS990i were extended to contact the waste ink absorber and the outlets of the two waste liquid tubes were spaced 5 cm apart.

Then, an "overrunning width for marginless printing" was set to 5 mm and a professional photopaper of 2L size (PR101 2L, Canon make) was chosen as a print medium. A sample image ISO/JIS-SCID (N3 fruit) was printed on 500 sheets continuously. No pigment ink was found deposited on the ink absorber. Therefore, the back of the print medium was not contaminated, nor was any print medium transport anomaly observed.

With a head refreshing selected in the property window of the printer driver, 500 suction-based recovery operations and preliminary ejection operations were performed. Satisfactory and reliable performance was confirmed in every operation. After the test, a check on the waste ink absorber and the preliminary ejection pads found no ink stagnating area or any closed waste ink path due to coagulates.

(Comparison 1)

For ejection of the four coloring inks K1, C1, M1, Y1 from the print heads of PIXUS990i, these inks were poured into the ink tanks which were then mounted. As to the absorbers, the products originally installed in PIXUS990i were used.

Then, an "overrunning width for marginless printing" was set to 5 mm and a professional photopaper of 2L size (PR101 2L, Canon make) was chosen as a print medium. A sample image ISO/JIS-SCID (N3 fruit) was printed on 500 sheets continuously. A deposit of colorant was observed on the ink absorber and sheets printed in a second half of the printing operation were found to be contaminated at their back.

With a head refreshing selected in the property window of the printer driver, 500 suction-based recovery operations and preliminary ejection operations were performed. The normal operation became difficult to continue halfway in the printing operation. A check on the waste ink absorber found ink stagnating areas and closed waste ink paths due to coagulates. The absorbing capability of the waste ink absorber was found degraded. Deposits of colorant were observed on the surface of the preliminary ejection pads.

(Comparison 2)

For ejection of the four coloring inks K1, C1, M1, Y1 and the reaction liquid S1 from the print heads of PIXUS990i, they were poured into the ink tanks in the same combination as the Verification 2 and these ink tanks were then mounted. As to the absorbers, the products originally installed in PIXUS990i were used.

Then, an "overrunning width for marginless printing" was set to 5 mm and a professional photopaper of 2L size (PR101 2L, Canon make) was chosen as a print medium. A sample image ISO/JIS-SCID (N3 fruit) was printed on 500 sheets continuously. A deposit of colorant was observed on the ink absorber and sheets printed in a second half of the printing operation were found to be contaminated at their back.

With a head refreshing selected in the property window of the printer driver, 500 suction-based recovery operations and preliminary ejection operations were performed. The normal operation became difficult to continue halfway in the printing operation. A check on the waste ink absorber found ink stagnating areas and closed waste ink paths due to coagulates. The absorbing capability of the waste ink absorber was found degraded. Deposits of colorant were observed on the surface of the preliminary ejection pads.

Second Embodiment

A second embodiment of this invention, particularly another construction of the suction-based recovery means, will be described.

Figure 18:
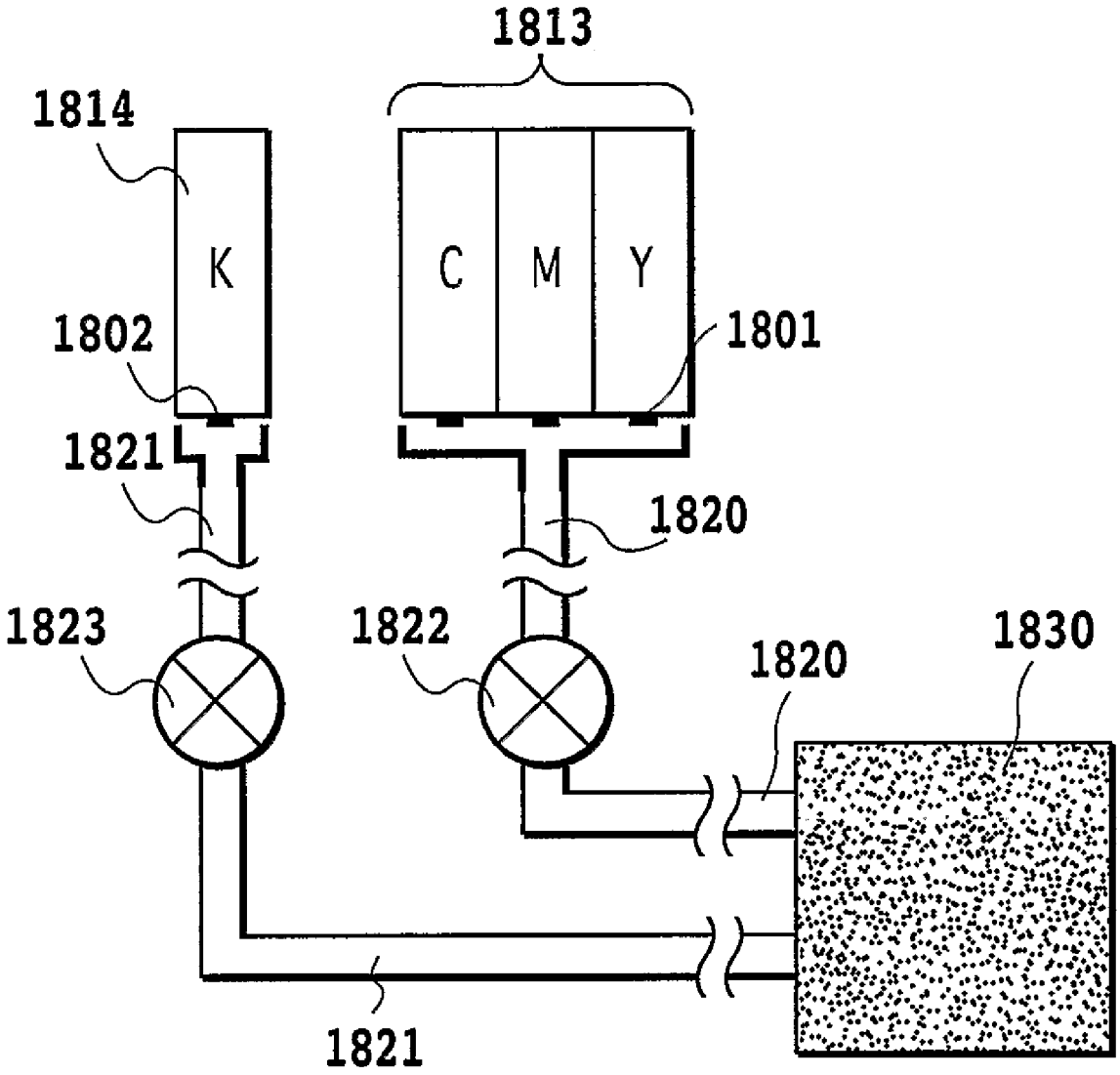
FIG. 18 illustrates a construction that uses an ink set so arranged as to cause a reaction between K and at least one of C, M and Y.

FIG. 18 shows a construction using an ink set in which a coloring ink K and at least one of coloring inks C, M, Y react with each other. In the figure, denoted 1813 are print heads for ejecting the inks C, M, Y. Denoted 1814 is a print head for ejecting a black ink K that reacts with at least one of C, M, Y inks to accelerate the coagulation of colorant. In this embodiment, the print heads 1813 for C, M, Y inks and the print head 1814 for K ink are subjected to the suction operations performed by independent pumps 1822 and 1823. As a result, the C, M, Y inks are drawn out from the nozzles 1801 of the print heads 1813 and the K ink from the nozzles 1802 of the print head 1814. Then, the C, M, Y inks reach the waste ink absorber 1830 through the tube 1820 and the K ink reaches the waste ink absorber 1830 through the tube 1821. The waste ink absorber 1830, a feature of this invention, is applied in advance with a material that inhibits reaction between the ink K and the inks C, M, Y (coagulation inhibitor). Thus, in the waste ink absorber 1830 the reaction or coagulation is inhibited, forming almost no coagulates, insoluble substances or ink stagnating areas such as those shown in FIG. 15. Therefore, the continued use of the printing apparatus does not cause any trouble with the suction operation.

Though not shown here, the waste ink absorber 1830 may be provided with a coagulation inhibitor supply means so that the coagulation inhibitor can be supplied to the absorber as required. The coagulation inhibitor is preferably supplied immediately after the power-on of the printing apparatus, or at predetermined intervals, or each time the suction-based recovery operation is executed.

An example of verification test conducted by the inventors of this invention to verify the effect of this embodiment will be explained as follows.

(Verification 3)

Inks C2, M2, Y2 that react with the black ink K1 to accelerate coagulation were made in the following process.

(Coloring Ink C2)

The following components were mixed and dissolved in water by thorough stirring and then filtered under pressure by a microfilter with a pore size of 3.0 μm of Fuji Film make to produce a coloring ink C2.

| | |
|---|---|
| Acetyleneglycol ethyleneoxide additive (Acetylenol EH (tradename) of Kawaken Fine Chemical) | 1 part |
| Trimethylolpropane | 6 parts |
| Glycerin | 6 parts |
| 2-pyrrolidone | 6 parts |
| CI acid blue 9 | 3 parts |
| Magnesium nitrate | 2 parts |
| Water | Remaining parts |

(Coloring Ink M2)

The following components were mixed and dissolved in water by thorough stirring and then filtered under pressure by a microfilter with a pore size of 3.0 μm of Fuji Film make to produce a coloring ink M2.

| | |
|---|---|
| Acetyleneglycol ethyleneoxide additive (Acetylenol EH (tradename) of Kawaken Fine Chemical) | 1 part |
| Trimethylolpropane | 6 parts |
| Glycerin | 6 parts |
| 2-pyrrolidone | 6 parts |
| CI acid red 52 | 3 parts |
| Magnesium nitrate | 2 parts |
| Water | Remaining parts |

(Coloring Ink Y2)

The following components were mixed and dissolved in water by thorough stirring and then filtered under pressure by a microfilter with a pore size of 3.0 μm of Fuji Film make to produce a coloring ink Y2.

| | |
|---|---|
| Acetyleneglycol ethyleneoxide additive (Acetylenol EH (tradename) of Kawaken Fine Chemical) | 1 part |
| Trimethylolpropane | 6 parts |
| Glycerin | 6 parts |
| 2-pyrrolidone | 6 parts |
| CI acid yellow 23 | 3 parts |
| Magnesium nitrate | 2 parts |
| Water | Remaining parts |

Next, by using the coagulation inhibiting liquid P1, the four ink absorbers for PIXUS560i were fabricated in a way similar to that of Verification 1 to complete an ink jet printing apparatus mounted with the ink absorbers of this embodiment.

A coloring ink K1 was filled into an ink tank BCI-3 eBK, a coloring ink C2 into an ink tank BCI-3eC, a coloring ink M2 into an ink tank BCI-3eM, and a coloring ink Y2 into an ink tank BCI-3eY. These ink tanks were mounted on a tank holder of PIXUS560i so that the four coloring inks could be ejected from the print heads of PIXUS560i. Then, two waste liquid tubes in PIXUS560i were extended to contact the waste ink absorber and the outlets of the two waste liquid tubes were spaced 5 cm apart.

Then, an "overrunning width for marginless printing" was set to 5 mm and a professional photopaper of 2L size (PR101 2L, Canon make) was chosen as a print medium. A sample image ISO/JIS-SCID (N3 fruit) was printed on 500 sheets continuously. No pigment ink was found deposited on the ink absorber. Therefore, the back of the print medium was not contaminated, nor was any print medium transport anomaly observed.

With a head refreshing selected in the property window of the printer driver, 500 suction-based recovery operations and preliminary ejection operations were performed. Satisfactory and reliable performance was confirmed in every operation. After the test, a check on the waste ink absorber and the preliminary ejection pads found no ink stagnating area or any closed waste ink path due to coagulates.

Third Embodiment

A third embodiment of this invention will be described as follows.

Figure 19:
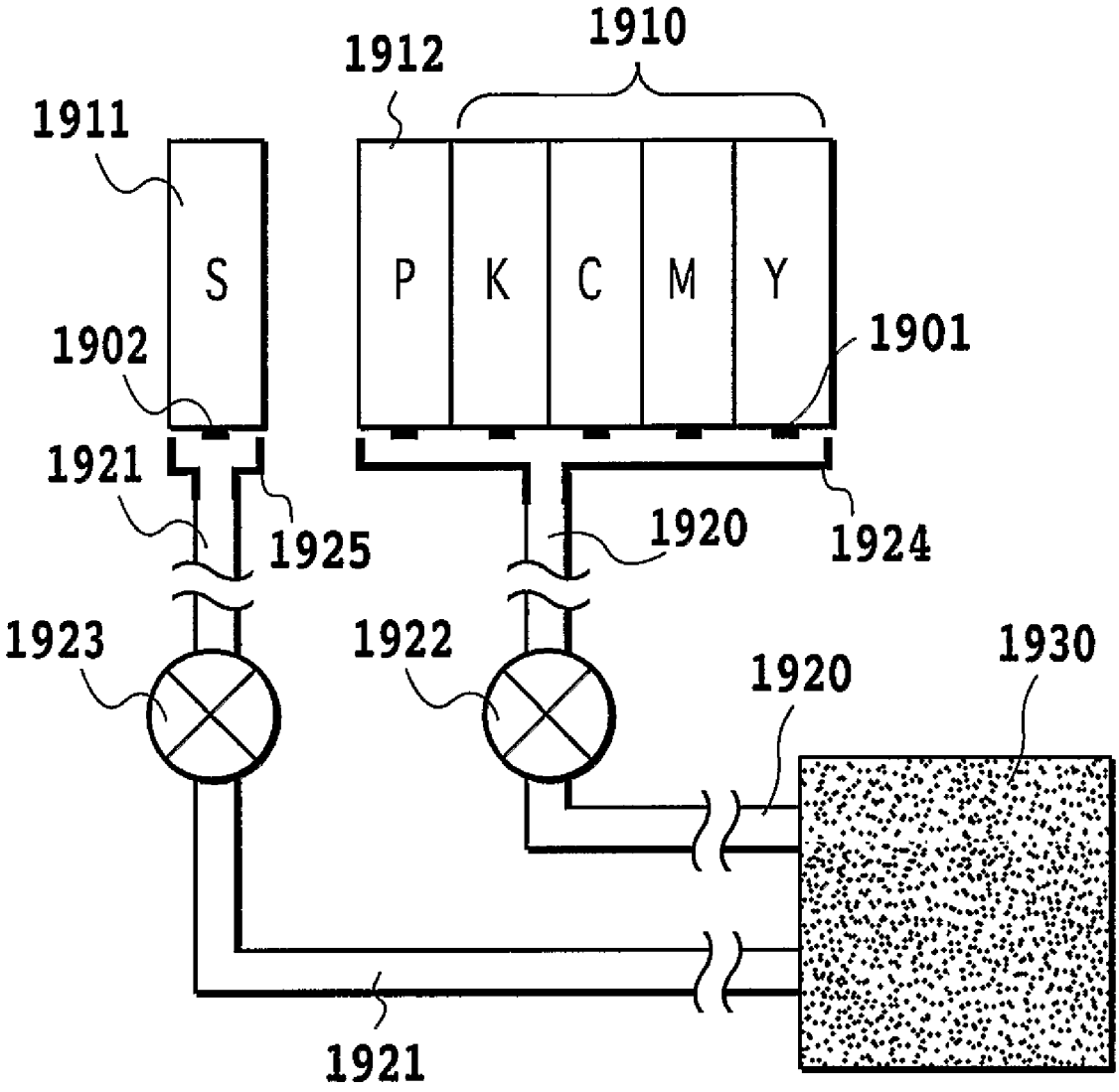
FIG. 19 illustrates a construction that has a print head so arranged as to eject coloring inks, a reaction liquid S and a coagulation inhibiting liquid.

FIG. 19 shows a construction which has, in addition to the coloring inks K, C, M, Y and the reaction liquid S that reacts with these inks, a print head for ejecting a solution containing a coagulation inhibitor that suppresses the reaction between the inks and the reaction liquid.

In the figure, denoted 1910 are print heads for ejecting inks K, C, M, Y. Denoted 1911 is a print head for ejecting a reaction liquid that reacts with the inks to accelerate the coagulation of colorants. Further, denoted 1912 is a print head for ejecting a coagulation inhibiting liquid that contains a coagulation inhibitor to inhibit the reaction between the inks and the reaction liquid. The coagulation inhibiting liquid, which, as described above, is intended to inhibit the coagulation of colorants, may or may not be similar in component to the coagulation inhibitor that is applied beforehand to the waste ink absorber 1930 and other absorbers of this embodiment.

In the figure, the print heads 1910 for the coloring inks and the head 1912 for the coagulation inhibiting liquid are suctioned by the pump 1922, and the print head 1911 for the reaction liquid is suctioned by the pump 1923. At this time the inks and the coagulation inhibiting liquid are drawn out from the nozzles 1901 of the print heads 1910 and 1912 into the same cap 1924 where the inks and the coagulation inhibiting liquid are mixed as a waste liquid at this stage. Then, the mixture liquid moves through the tube 1920 to the waste ink absorber 1930. On the other hand, the reaction liquid is sucked out from the nozzles 1902 of the print head 1911 into the cap 1925 from which it flows through the tube 1921 to the waste ink absorber 1930.

With this embodiment, since the coagulation inhibiting liquid can be ejected from the print head 1912, a variety of additional effects can be produced. For example, by performing the ejection of only the coagulation inhibiting liquid toward the cap 1924 and the suction operation by the pump 1922 appropriately, the waste ink absorber 1930 can be supplied the coagulation inhibiting liquid as necessary, enhancing the absorbing capability of the waste ink absorber for a long period of time.

Also, by setting a scan for applying the coagulation inhibiting liquid to the ink absorber before performing a printing scan during the "marginless printing", the absorbing capability of the ink absorber during the "marginless printing" can be enhanced. Further, ejecting the coagulation inhibiting liquid toward the preliminary ejection pads prior to the preliminary ejection of inks and reaction liquid can alleviate the ink coagulation on the surface and in the interior of the preliminary ejection pads.

Other Embodiments

In the first to third embodiment described above, a reaction occurs between inks and a reaction liquid or among inks. It is noted, however, that the invention is not limited to this configuration and that it is not essential for the liquids used to be reactive with each other. The only requirement is that colorants contained in the inks tend to coagulate on the surface of the ink absorber and that an arrangement is made to ensure the inhibition of the coagulation of colorants by the coagulation inhibiting liquid. If this requirement is met, the intended effect of the invention can be produced.

Further, while in the first to third embodiment the absorbers, such as an ink absorber for marginless printing, a waste ink absorber and preliminary ejection pads, contain the coagulation inhibitor in advance, this invention is not limited to this configuration. The coagulation inhibitor may be applied to the ink absorber at a predetermined timing. To alleviate the colorant stagnation near the surface of the absorber only requires the coagulation inhibitor to be applied to the absorber before the inks and reaction liquid are introduced to the absorber. Therefore, the coagulation inhibitor is applied at an appropriate timing before the inks and reaction liquid are introduced to the absorber.

While in the above embodiment, our explanation concerns a waste ink absorber, preliminary ejection pads and an ink absorber for marginless printing, this invention is not limited to this configuration. Since the ink jet printing apparatus uses liquids of inks, absorbers may be installed at various other locations than those described above so as to keep the interior of the apparatus from being contaminated. This invention can effectively be applied to a variety of ink absorbers installed at whatever locations or for whatever purposes. Further, two or more or all of the ink absorbers may be constructed integral in the apparatus. For example, the waste ink absorber and the absorber for "marginless printing" can be constructed of a single member that is laid on the bottom surface of the printing apparatus and this invention remains as effective.

With this invention, the coagulation of colorants on the surface, or in the interior, of an absorber can be inhibited, allowing the colorants to be absorbed quickly and uniformly into the interior of the absorber. This alleviates the problems caused by deposition of colorants on the surface of the absorber and by the degradation of its absorbing capability, thereby keeping the image output in good condition.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2004-336365 filed Nov. 19, 2004, which is hereby incorporated by reference herein.

The invention claimed is:

1. An ink jet printing apparatus for printing by ejecting an ink containing a colorant from a print head onto a print medium, comprising:

at least one ink absorber configured to absorb the ink discharged from the print head, wherein the at least one ink absorber contains a coagulation inhibitor inhibiting coagulation of the colorant contained in the ink discharged from the print head by preventing contact among particles of the colorant due to an effect of steric hindrance, and wherein the coagulation inhibitor includes a nonionic surfactant with five or more ethylene oxide groups.

2. An ink jet printing apparatus according to claim 1, further comprising:

a platen configured to support the print medium and configured to be arranged in a position facing the print head, wherein the at least one ink absorber is installed in the platen to absorb the ink ejected outside the print medium when a printing operation is performed on edge portions of the print medium.

3. An ink jet printing apparatus according to claim 1, further comprising:

preliminary ejection means for causing the print head to perform a preliminary ejection of the ink; and a preliminary ejection receiver for receiving the ink ejected by the preliminary ejection means, wherein the at least one ink absorber absorbs the ink received in the preliminary ejection receiver.

4. An ink jet printing apparatus according to claim 1, further comprising:

ink discharging means for discharging the ink from the print head by a method other than ejection of the ink by the print head; and an ink discharging path for transporting the ink discharged by the ink discharging means, wherein the at least one ink absorber absorbs the ink transported through the ink discharging path.

5. An ink jet printing apparatus according to claim 4, further comprising:

a reaction liquid head for ejecting a reaction liquid, the reaction liquid accelerating coagulation of the colorant contained in the ink;

reaction liquid discharging means for discharging the reaction liquid from the reaction liquid head; and a reaction liquid discharging path for transporting the reaction liquid discharged by the reaction liquid discharging means, wherein the at least one ink absorber absorbs the ink transported through the ink discharging path and the reaction liquid transported through the reaction liquid discharging path.

6. An ink jet printing apparatus according to claim 1, further comprising:

a reaction liquid head for ejecting a reaction liquid, the reaction liquid accelerating coagulation of the colorant contained in the ink.

7. An ink jet printing apparatus according to claim 1, further comprising:

supply means for supplying the coagulation inhibitor to the at least one ink absorber.

8. An ink jet printing apparatus according to claim 7, wherein said supply means comprises a coagulation inhibiting liquid head for ejecting the coagulation inhibitor.

9. An ink jet printing apparatus for printing by ejecting an ink containing a colorant from a print head to a print medium, comprising:

an ink absorber for absorbing the ink discharged from the print head; and application means for applying a coagulation inhibitor to the ink absorber, the coagulation inhibitor inhibiting coagulation of the colorant contained in the ink discharged from the print head by preventing contact among particles of the colorant due to an effect of steric hindrance, wherein the coagulation inhibitor includes a nonionic surfactant with five or more ethylene oxide groups.

10. A method of manufacturing an ink absorber used for an ink jet printing apparatus for printing by ejecting an ink containing a colorant from a print head to a print medium, the ink absorber for absorbing the ink discharged from the print head, said method comprising the steps of:

immersing the ink absorber in a liquid containing a coagulation inhibitor, the coagulation inhibitor for inhibiting coagulation of the colorant contained in the ink discharged from the print head by preventing contact among particles of the colorant due to an effect of steric hindrance, wherein the coagulation inhibitor includes a nonionic surfactant with five or more ethylene oxide groups; and drying the ink absorber that was immersed in the liquid.

11. An ink absorber manufactured by the method of claim 10.

* * * * *